US011313079B2

(12) United States Patent
Collins et al.

(10) Patent No.: US 11,313,079 B2
(45) Date of Patent: Apr. 26, 2022

(54) TWILL WOVEN PAPERMAKING FABRICS

(71) Applicant: Kimberly-Clark Worldwide, Inc., Neenah, WI (US)

(72) Inventors: Lynda Ellen Collins, Neenah, WI (US); Mark Alan Burazin, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/650,050

(22) PCT Filed: Sep. 27, 2018

(86) PCT No.: PCT/US2018/053070

§ 371 (c)(1),
(2) Date: Mar. 24, 2020

(87) PCT Pub. No.: WO2019/067686

PCT Pub. Date: Apr. 4, 2019

(65) Prior Publication Data

US 2020/0291577 A1 Sep. 17, 2020

Related U.S. Application Data

(60) Provisional application No. 62/565,582, filed on Sep. 29, 2017.

(51) Int. Cl.
*D21F 7/08* (2006.01)
*D21F 11/00* (2006.01)
(Continued)

(52) U.S. Cl.
CPC ..... *D21F 7/08* (2013.01); *D21F 11/006* (2013.01); *D21F 11/14* (2013.01); *D21H 27/002* (2013.01); *D21H 27/02* (2013.01)

(58) Field of Classification Search
CPC ..... D21F 7/08; D21F 11/006; D21F 11/14; D21F 5/18; D21F 1/00; D21F 1/0036; D21H 27/002; D21H 27/02; D03D 13/00
See application file for complete search history.

(56) References Cited

U.S. PATENT DOCUMENTS 5,228,482 A 7/1993 Fleischer
5,240,763 A 8/1993 Wagner et al.
(Continued)

FOREIGN PATENT DOCUMENTS

CN 2885922 Y 4/2007
CN 204000435 U 12/2014
(Continued)

OTHER PUBLICATIONS

Co-pending U.S. Appl. No. 16/650,058, filed Mar. 24, 2020, by Collins et al. for "Woven Papermaking Fabric Including Stablilized Weave Providing Textured Contacting Surface."
(Continued)

*Primary Examiner* — Eric Hug
*Assistant Examiner* — Matthew M Eslami
(74) *Attorney, Agent, or Firm* — Kimberly-Clark Worldwide, Inc.

(57) ABSTRACT

The invention provides woven papermaking fabrics having a machine direction (MD) axis and a cross-machine direction (CD) axis, a machine contacting surface and a sheet contacting surface where the sheet contacting surface comprises a plurality of twill woven protuberances defining valleys there between. Generally the protuberances are skewed relative to a principle axis of the fabric, such as the MD axis and have a non-zero element angle. The protuberances generally have an upper surface defining the upper most surface plane of the web contacting surface of the fabric. Further, the protuberance upper surface is substan-
(Continued)

tially planar providing the protuberances with a height that is substantially constant along the length of the protuberance.

22 Claims, 19 Drawing Sheets

(51) Int. Cl.

| | |
|---|---|
| ***D21F 11/14*** | (2006.01) |
| ***D21H 27/00*** | (2006.01) |
| ***D21H 27/02*** | (2006.01) |

(56) References Cited

U.S. PATENT DOCUMENTS

| | | | |
|---|---|---|---|
| 5,456,293 | A | 10/1995 | Ostermayer et al. |
| 5,520,225 | A | 5/1996 | Quigley et al. |
| 5,713,397 | A | 2/1998 | Quigley |
| 5,832,962 | A | 11/1998 | Kaufman et al. |
| 6,402,895 | B1 | 6/2002 | Best |
| 6,660,362 | B1 | 12/2003 | Lindsay et al. |
| 6,673,202 | B2 | 1/2004 | Burazin et al. |
| 7,166,189 | B2 | 1/2007 | Burazin et al. |
| 7,235,156 | B2 | 6/2007 | Baggot |
| 7,294,229 | B2 | 11/2007 | Hada et al. |
| 7,300,543 | B2 | 11/2007 | Mullally et al. |
| 7,611,605 | B2 | 11/2009 | Burazin et al. |
| 7,611,607 | B2 | 11/2009 | Mullally et al. |
| 7,726,349 | B2 | 6/2010 | Mullally et al. |
| 7,935,409 | B2 | 5/2011 | Burazin et al. |
| 2001/0032712 | A1 | 10/2001 | Friedbauer et al. |
| 2002/0056536 | A1* | 5/2002 | Lamb ..... D21F 11/006 162/100 |
| 2003/0079850 | A1 | 5/2003 | Rougvie |
| 2003/0084952 | A1 | 5/2003 | Burazin et al. |
| 2007/0209770 | A1 | 9/2007 | Barrett et al. |
| 2008/0110591 | A1* | 5/2008 | Mullally ..... D21F 11/006 162/358.2 |
| 2008/0169040 | A1 | 7/2008 | Barrett |
| 2014/0231039 | A1* | 8/2014 | Patel ..... D21F 7/12 162/289 |
| 2016/0215451 | A1 | 7/2016 | Uymur et al. |
| 2017/0211235 | A1* | 7/2017 | Lamb ..... D21H 27/02 |

FOREIGN PATENT DOCUMENTS

| | | | |
|---|---|---|---|
| CN | 206438338 | U | 8/2017 |
| WO | 0012817 | A1 | 3/2000 |
| WO | 13023276 | A1 | 2/2013 |
| WO | 15149992 | A1 | 10/2015 |
| WO | 20068091 | A1 | 4/2020 |
| WO | 20068092 | A1 | 4/2020 |

OTHER PUBLICATIONS

Co-pending U.S. Appl. No. 16/650,065, filed Mar. 24, 2020, by Collins et al. for "Woven Papermaking Fabric Having Converging, Diverging or Merging Topography."

Co-pending U.S. Appl. No. 16/650,068, filed Mar. 24, 2020, by Collins et al. for "Woven Papermaking Fabric Having Machine and Cross-Machine Oriented Topography."

* cited by examiner

| PARAMETERS | VALUE | UNIT |
|---|---|---|
| ISOTROPY | 1.36 | % |
| FIRST DIRECTION | 85.2 | ° |
| SECOND DIRECTION | 92.6 | ° |
| THIRD DIRECTION | 2.25 | ° |

| PARAMETERS | VALUE | UNIT |
|---|---|---|
| ISOTROPY | 1.74 | % |
| FIRST DIRECTION | 83.7 | ° |
| SECOND DIRECTION | 179 | ° |
| THIRD DIRECTION | 0.195 | ° |

| | | | | | | | |
|---|---|---|---|---|---|---|---|
| 30 | | | I | | | | |
| 31 | Z | | | I | I | I | 31 |
| 32 | | I | | | I | I | 32 |
| 33 | | | I | | I | I | 33 |
| 34 | I | | | Z | I | I | 34 |
| 35 | | I | | | I | I | 35 |
| 36 | | | I | | I | I | 36 |
| 37 | Z | | | I | I | I | 37 |
| 38 | | I | | | I | | 38 |
| 39 | | | I | I | I | Z | 39 |
| 40 | I | | | I | I | | 40 |
| 41 | | I | | I | I | | 41 |
| 42 | | | Z | I | I | I | 42 |
| 43 | I | | | I | I | | 43 |
| 44 | | I | | I | I | | 44 |
| 45 | | | I | I | I | Z | 45 |
| 46 | I | | | I | | | 46 |
| 47 | | I | I | I | Z | | 47 |
| 48 | | | I | I | | I | 48 |
| 49 | I | | I | I | | | 49 |
| 50 | | Z | I | I | I | | 50 |
| 51 | | | I | I | | I | 51 |
| 52 | I | | I | I | | | 52 |
| 53 | | I | I | I | Z | | 53 |
| 54 | | | I | I | | I | 54 |
| 55 | I | | I | I | | | 55 |
| 56 | | Z | I | I | I | | 56 |
| 57 | | | I | | | I | 57 |
| 58 | Z | I | I | I | | | 58 |
| 59 | | I | I | | I | | 59 |

I :WARP ABOVE SHUTES

:WARP BETWEEN SHUTES

Z :WARP BELOW SHUTES

FIG. 10B

TWILL WOVEN PAPERMAKING FABRICS

In the manufacturing of tissue products, particularly absorbent tissue products such as bath tissue and facial tissue products, there is a continuing need to improve the physical properties of the tissue and offer a differentiated product appearance. It is generally known that molding a partially dewatered cellulosic web on a topographical papermaking fabric will enhance the finished paper product's physical properties, such as sheet bulk, stretch and softness, and aesthetics. Such molding can be applied by fabrics in a through-air dried process, such as the process disclosed in U.S. Pat. No. 5,672,248, or in a wet-pressed tissue manufacturing process, such as that disclosed in U.S. Pat. No. 4,637,859.

BACKGROUND OF THE INVENTION

Exemplary papermaking fabrics are disclosed in U.S. Pat. No. 6,998,024, which teaches woven papermaking fabrics with substantially continuous machine direction ridges whereby the ridges are made up of multiple warp filaments grouped together. The ridges are higher and wider than individual warps. The wide wale ridges have a ridge width of about 0.3 cm or greater and the frequency of occurrence of the ridges in the CD is from about 0.2 to 3 per centimeter. In the examples shown, the shute diameters are either larger than or smaller than the warp diameters but only one shute diameter is utilized.

Other woven papermaking fabrics are disclosed in U.S. Pat. No. 7,611,607, which teaches fabrics having substantially continuous, not discrete, machine-direction ridges separated by valleys, where the ridges are formed of multiple warp filaments grouped together and supported by multiple shute strands of two or more diameters. The ridges are generally oriented parallel to the machine direction axis of the fabric, however, in certain instances the ridges are oriented at an angle of about 5 degrees relative to the machine direction axis. In those instance where the ridges are angled relative to the machine direction axis, they may be woven so as to regularly reverse direction in terms of movement in the cross-machine direction, creating a wavy appearance which can enhance aesthetics of the resulting tissue product. While the ridges could be angled with respect to the machine direction axis, the degree of orientation is limited. Moreover, the ridges could not be woven to a have a height that was substantially continuous along their length.

Thus, the prior art woven papermaking fabrics have generally been limited to topographies oriented substantially in the machine direction, with some small degree of variability. Machine direction oriented topography presents several problems primarily in fabric manufacturing and in limitations in aesthetic appearances that can be created. Machine direction oriented topography often relies upon warp filaments to form machine direction oriented ridges with fewer interchanges than warp filaments in the adjacent valleys causing differences in warp tension. The tension differences often result in the ridges of the fabric becoming slack and ceasing to weave. Once a warp filament ceases to weave into the fabric, they become so slack that they are in danger of being broken by the projectile of the loom. Thus, there remains a need in the art for a new weave structure to address the limitations of current weave structures for woven paper machine clothing.

SUMMARY

The present inventors have now discovered new weave patterns for the manufacture of woven papermaking fabrics that allow the web contacting surface of the fabric to be woven with three-dimensional topography comprising protuberances that are oriented at an angle relative to a principle axis of the fabric, such as the machine direction (MD) axis or the cross-machine direction (CD) axis. The protuberances may be discrete or continuous and, in certain preferred embodiments, are uninterrupted along their length to provide the protuberance with a relatively constant height along its length.

Accordingly, in one embodiment the present invention provides woven papermaking fabric having a machine direction axis and a cross-machine direction axis, the fabric comprising: a plurality of machine direction (MD) oriented warp filaments and a plurality of substantially cross-machine direction (CD) oriented shute filaments, the shute filaments being interwoven with warp filaments to provide a machine contacting fabric side and opposed web contacting fabric side, the web contacting fabric side having a plurality of protuberances disposed thereon, the plurality of protuberances each having a length, a height and an upper surface that is substantially planar, the plurality of protuberances having a non-zero element angle and spaced apart from one another to define a plurality of valleys there between. In certain instances the element angle may range from 0.5 to 20 degrees. In other instances the element angle may range from about −20 to −0.5 degrees.

In other embodiments the present invention provides a woven papermaking fabric comprising a plurality of protuberances disposed on the web contacting surface wherein the protuberances change direction such that the web contacting surface of the fabric may have a protuberance having segments with different principal axis of orientation and different element angles. The ability to weave papermaking fabrics having protuberances skewed at an angle relative to a principle axis of the fabric, as the MD or CD axis, and the ability to vary the angle within a given protuberance, enables the production of fabrics useful in the manufacture of tissue products having visually distinctive patterns and improved physical properties.

In still other embodiments the present invention provides weave patterns that may be used to produce woven papermaking fabrics having curvilinear protuberances. The ability to weave curvilinear protuberances enables a wide breadth of designs to be created such as waves and arcs, which may be incorporated into tissue products manufactured using the inventive papermaking fabrics.

In other embodiments the present invention provides weave patterns that may be used to produce woven papermaking fabrics comprising valleys having steep side wall angles of about 20 degrees and more preferably greater than about 22 degrees and still more preferably greater than about 24 degrees, such as from about 20 to about 45 degrees and more preferably from about 22 to about 40 degrees. In addition to having relatively steep wall angles, the woven fabrics have valleys that provide superior fiber support and uniformity in pore size.

In still other embodiments present invention provides a woven papermaking fabric having a machine contacting surface and a web contacting surface wherein the web contacting surface comprises a three-dimensional topography consisting of protuberances having an element angle greater than about 0.5 degrees, such as from about 0.5 to about 20 degrees and more preferably from about 2.0 to about 10.0 degrees, the protuberances comprising a plurality of warp filaments, such as two, three, four or more warp filaments, that are staggered by two or more shute floats, but overlap to some degree. The warp filaments forming a protuberance can vary in length, but typically rise over from about five to about forty, such as from about ten to about thirty shute floats, depending on the size and spacing of the shute floats. The extent to which warp filaments forming a given protuberance overlap each other may vary. For example, the outermost warp filaments forming a protuberance may overlap each other from two to ten shute floats and more preferably from about three to eight shute floats, allowing the end of one warp float to tuck under the directly adjacent machine direction oriented warp float. In this manner the weave pattern yields protuberances comprising warp stacks with a degree of symmetry where warps are introduced and ended in uniform spacing. Further, the weave pattern may yield protuberances having a twisted rope appearance that provides a stable protuberance having good height and sidewall angles and is visually appealing.

In yet other embodiments the present invention provides a weave pattern comprising two or more machine direction oriented warp filaments, such as from two to eight warp filaments or four to six warp filaments, woven to form a protuberance on the web contacting surface where the distal end of a first warp float and the proximal end of an adjacent warp float overlap one another a distance of two to ten shute floats and more preferably from about three to eight shute floats.

In other embodiments the present invention provides woven papermaking fabric having a machine contacting surface and a web contacting surface wherein the web contacting surface comprises a three-dimensional topography consisting of a plurality of parallel, spaced apart MD oriented protuberances having a length, a width and an element angle greater than about 0.5 degrees, each protuberance having an upper surface plane that extends uninterrupted along the length of the protuberance and wherein the protuberance comprises two or more directly adjacent warp filaments, wherein each warp filament has a float length from 4 to 50, and the warp filaments have a paired portion having a float length from 2 to 10.

BRIEF DESCRIPTION OF DRAWINGS

FIG. 10A-10B illustrates one weave pattern useful in the manufacture of a woven papermaking fabric according to the present invention;

DEFINITIONS

Figure 1:
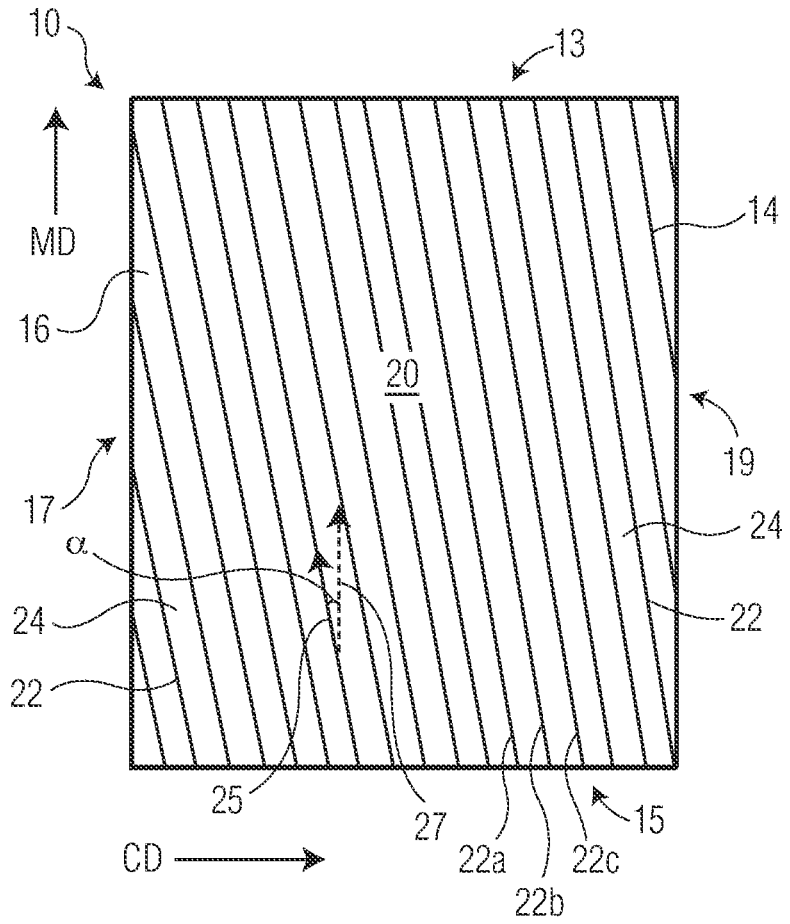
FIG. 1 is a top view of a woven papermaking fabric having a three-dimensional fabric contacting surface according to one embodiment of the present invention.

As used herein, the term "tissue product" refers to products made from tissue webs and includes, bath tissues, facial tissues, paper towels, industrial wipers, foodservice wipers, napkins, medical pads, medical gowns, and other similar products. Tissue products may comprise one, two, three or more plies.

As used herein, the terms "tissue web" and "tissue sheet" refer to a fibrous sheet material suitable for forming a tissue product.

As used herein, the term "papermaking fabric" means any woven fabric used for making a cellulosic web such as a tissue sheet, either by a wet-laid process or an air-laid process. Specific papermaking fabrics within the scope of this invention include forming fabrics; transfer fabrics conveying a wet web from one papermaking step to another, such as described in U.S. Pat. No. 5,672,248; as molding, shaping, or impression fabrics where the web is conformed to the structure through pressure assistance and conveyed to another process step, as described in U.S. Pat. No. 6,287,426; as creping fabrics as described in U.S. Pat. No. 8,394,236; as embossing fabrics as described in U.S. Pat. No. 4,849,054; as a structured fabric adjacent a wet web in a nip as described in U.S. Pat. No. 7,476,293; or as a through-air drying fabric as described in U.S. Pat. Nos. 5,429,686, 6,808,599 B2 and 6,039,838. The fabrics of the invention are also suitable for use as molding or air-laid forming fabrics used in the manufacture of non-woven, non-cellulosic webs such as baby wipes.

Fabric terminology used herein follows naming conventions familiar to those skilled in the art. For example, as used herein the term "warps" generally refers to machine direction filaments and the term "shutes" generally refers to cross-machine direction filaments, although it is known that fabrics can be manufactured in one orientation and run on a paper machine in a different orientation.

As used herein, the term "directly adjacent" when referring to the relation of one filament to another means that no other filaments are disposed between the referenced filaments. For example, if two warp filaments forming a portion of a protuberance are said to be directly adjacent to one another no other warp filaments are disposed between the two protuberance forming warp filaments.

As used herein, the term "protuberance" generally refers to a three-dimensional element formed by one or more warp filaments woven above a plurality of shute filaments. Protuberances may be referred to herein alternatively as three-dimensional elements or simply as elements.

As used herein, the term "protuberance forming portion" refers to the woven warp filaments that form a portion of the protuberance. In certain instances the protuberance forming portion may comprise a plurality of adjacent warp/shute filament interchanges that are woven such that the warp filaments are woven above their respective shute filaments. The protuberance forming portion may extend substantially in the machine direction and extend over at least five shute filaments in the machine direction, or at least seven shute filaments, or at least ten shute filaments.

As used herein, the term "valley" generally refers to a portion of the web contacting surface of the papermaking fabric lying between adjacent protuberances.

As used herein, the "valley bottom" is defined by the top of the lowest visible filament which a tissue web can contact when molding into the textured fabric. The valley bottom can be defined by a warp knuckle, a shute knuckle, or by both. The "valley bottom plane" is the z-direction plane intersecting the top of the elements comprising the valley bottom.

As used herein, the term "valley depth" generally refers to z-directional depth of a given valley and is the difference between C2 (95 percentile height) and C1 (5 percentile height) values, having units of millimeters (mm), as measured by profilometry and described in the Test Method section below. In certain instances valley depth may be referred to as S90. To determine valley depth a profilometry scan of a fabric is generated as described herein, from which a histogram of the measured heights is generated, and an S90 value (95 percentile height (C2) minus the 5 percentile height (C1), expressed in units of mm) is calculated. Generally the instant fabrics have relatively deep valleys, such as valleys having valley depths greater than about 0.30 mm, more preferably greater than about 0.35 mm and still more preferably greater than about 0.40 mm, such as from about 0.30 to about 1.0 mm.

As used here, the term "valley width" generally refers to the width of a valley disposed on a fabric according to the present invention and is the Psm value, having units of millimeters (mm), as measured by profilometry and described in the Test Method section below. Generally valley width is measured along a line drawn normal to the machine direction axis of the fabric that intersects at least two adjacent MD orientated protuberances. The valley width of a given fabric may vary depending on the weave pattern, however, in certain instances the valley width may be greater than about 1.0 mm, more preferably greater than about 1.5 mm and still more preferably greater than about 2.0 mm, such as from about 1.5 to about 3.5 mm.

As used herein, the term "element angle" generally refers to the orientation of the machine direction (MD) oriented protuberances relative to the MD axis of the fabric. Element angle is generally measured by profilometry and described in the Test Method section below. Preferably the fabrics of the present invention have an element angle greater or less than 0, such as from about −20 to about −0.5 degrees or from about 0.5 to about 20 degrees. In certain instances the element angle is positive and is greater than about 0.5 degrees, more preferably greater than about 2.0 degrees and still more preferably greater than about 4.0 degrees, such as from about 0.5 to about 20 degrees, such as from about 2.0 to about 10 degrees. In other instances the inventive fabrics may be woven as described herein to provide machine direction (MD) oriented protuberances having element angles which are negative as well, such as from about −20 to about −0.5 degrees and more preferably from about −10 to about −0.5 degrees.

As used herein, the term "wall angle" generally refers to the angle formed between a given valley bottom and an adjacent machine direction (MD) orientated protuberance and is the Pdq value, having units of degrees (°), as measured by profilometry and described in the Test Method section below. Generally the wall angle is measured along line drawn normal to the machine direction axis of the fabric that intersects at least two adjacent MD orientated protuberances. The instant fabrics may have MD orientated protuberances with relatively steep wall angles, such as wall angles greater than about 20 degrees and more preferably greater than about 22 degrees and still more preferably greater than about 24 degrees, such as form about 20 to about 45 degrees and more preferably from about 22 to about 40 degrees.

As used herein the term "discrete" when referring to an element of a papermaking fabric according to the present invention, such as a valley, means that the element is visually unconnected from other elements and does not extend continuously in any dimension of the papermaking fabric surface.

As used herein, the term "discrete protuberance" refers to separate, unconnected three-dimensional elements disposed on a papermaking fabric that do not extend continuously in any dimension of the fabric. A protuberance may be discrete despite being formed from a single continuous filament. For example, a single continuous warp filament may be woven such that it forms a plurality of discrete machine direction oriented protuberances where each protuberance has a first proximal end and a first distal end where the ends of the protuberance terminate at spaced apart shute filaments.

As used herein the term "continuous" when referring to a three-dimensional element of a papermaking fabric according to the present invention, such as a protuberance or a pattern, means that the element extends throughout one dimension of the papermaking fabric surface. When referring to a protuberance the term refers to a protuberance comprising two or more warp filaments that extends without interruption throughout one dimension of the woven fabric.

As used herein, the term "uninterrupted" generally refers to a protuberance having an upper surface plane that extends without interruptions and remains above the valley bottom plane for length of the protuberance. Undulations of the upper surface plane within a protuberance along its length such as those resulting from twisting of warp filaments or warp filaments forming the protuberance tucking under one another are not considered to be interruptions.

As used herein the term "line element" refers to a three-dimensional element of a papermaking fabric, such as a protuberance, in the shape of a line, which may be continuous, discrete, interrupted, and/or a partial line with respect to a fabric on which it is present. The line element may be of any suitable shape such as straight, bent, kinked, curled, curvilinear, serpentine, sinusoidal, and mixtures thereof. In one example, a line element may comprise a plurality of discrete elements that are oriented together to form a visually continuous line element.

As used herein the term "pattern" refers to any non-random repeating design, figure, or motif. Generally the fabrics of the present invention may comprise decorative patterns comprising a plurality of line elements, however, it is not necessary that the line elements form recognizable shapes, and a repeating design of the line elements is considered to constitute a decorative pattern.

As used herein the term "twill pattern" generally refers to a pattern of continuous, parallel, spaced apart MD orientated protuberances having a non-zero element angle. In a twill pattern the MD oriented protuberances are woven from two or more directly adjacent warp filaments having a paired portion having a float length from 2 to 8.

DETAILED DESCRIPTION

The present inventors have now surprisingly discovered that certain woven papermaking fabrics, and in particular woven transfer and through-air drying (TAD) fabrics, having patterns disposed thereon that may be used to produce tissue webs and products having high bulk and visually appealing aesthetics without compromising operating efficiency. Papermaking fabrics of the current invention are generally directed to woven fabrics but may be suitable as base fabrics upon which to add additional material to enhance tissue physical properties or aesthetics. For example, the instant woven fabrics may be used in the manufacture of a papermaking fabric having a foraminous woven base member surrounded by a hardened photosensitive resin framework. In other instances the instant woven fabrics may be used in the manufacture of a papermaking fabric having a foraminous woven base member with a polymeric material disposed thereon by printing, extruding or well-known additive manufacturing processes.

The present fabrics may be used in the manufacture of a broad range of fibrous structures, particularly wet-laid fibrous structures and more particularly, wet-laid tissue products such as bath tissues, facial tissues, paper towels, industrial wipers, foodservice wipers, napkins and other similar products. Further, the inventive fabrics are well suited for use in a wide variety of tissue manufacturing processes. For example, the fabrics may be used as TAD fabrics in either uncreped or creped applications to generate aesthetically acceptable patterns favorable tissue product physical properties. Alternatively, the fabrics may be used as impression fabrics in wet-pressed papermaking processes.

Accordingly, in one embodiment, the invention resides in a woven papermaking fabric having a machine direction axis and a cross-machine direction axis, a machine contacting surface and a sheet contacting surface where the sheet contacting surface is textured and comprises a plurality of protuberances oriented at an angle relative to the machine direction (MD) axis of the fabric. In certain instances the protuberances may be MD oriented and have a non-zero element angle, such as an element angle greater than about 0.5 degrees, such as from about 0.5 to about 20 degrees, and more preferably from about 2.0 to about 15 degrees and still more preferably from about 5.0 to about 10 degrees. One skilled in the art will appreciate that in other instances the inventive fabrics may also be woven such that the protuberance have a negative element angle, such as an element angle from about −20 to about −0.5, more preferably from about −15 to −2.0 degrees and still more preferably from about −10 to about −5.0 degrees.

Although the woven papermaking fabrics described herein are generally described as having a web contacting surface comprising a plurality of protuberances oriented at an angle relative to the MD axis of the fabric, one skilled in the art will appreciate that the weave patterns may be readily adapted to form protuberances oriented at an angle relative to the cross-machine direction axis of the fabric. Thus, in certain embodiments the invention provides a woven papermaking fabric comprising substantially cross-machine direction (CD) oriented protuberances having a non-zero element angle, relative to the CD axis of the fabric, such as an element angle greater than about 0.5 degrees, such as from about 0.5 to about 20 degrees, and more preferably from about 2.0 to about 15 degrees and still more preferably from about 5.0 to about 10 degrees.

The protuberances generally comprise two or more directly adjacent warp filaments supported by a shute strand. For example, two, three, four or more warp filaments may be combined to form a protuberance, also referred to as a three-dimensional element or simply as a line element, on the web contacting surface of the fabric. Accordingly, in certain embodiments a protuberance may comprise from two or more warp filaments, such as from two to six warp filaments that are woven above their corresponding shute filaments. In this manner the protuberance is not intersected or interrupted by shute filaments along its length resulting in a protuberance having an upper surface plane that is uninterrupted and protuberance with a relatively constant height along its length.

The warp filaments forming the protuberance may extend substantially in the machine direction and extend over at least four shute filaments in the machine direction, or at least seven shute filaments, or at least ten shute filaments. In certain embodiments the warp may extend four to fifty shute filaments, such as from six to forty shute filaments. When referring to the number of shute floats traversed by the warp filaments forming a given element the term "float length" will be used. For example, a warp filament forming the protuberance that extends substantially in the machine direction over five shute filaments is said to have a float length of five.

The warp filaments forming the protuberance are woven such that they are laterally offset from one another in the machine direction. In this manner the distal end of a first warp filament and the proximal end of a directly adjacent warp filament overlap to an extent to form a paired portion. The paired portion may have a float length from two to ten and more preferably from three to eight. Weaving the warp filaments in this paired, offset, manner allows the end of one warp float to tuck under the next machine direction oriented warp float. As a result the weave pattern yields protuberances comprising warp stacks with a degree of symmetry where warps are introduced and ended in uniform spacing.

The warp filaments may be woven to form protuberances that form a twill pattern that extends in a continuous manner across the fabric. The twill pattern is formed from parallel protuberances having a principal axis that while generally oriented in the machine direction (MD) is slightly skewed to provide an element angle from about 0.5 to about 20 degrees relative to the machine direction axis. Between adjacent protuberances are valleys, which may also be continuous like the protuberances that bound them, oriented at an angle relative to the machine direction axis. In a particularly preferred embodiment the protuberances forming the twill pattern are linear and provide valleys having linear sidewalls.

While in certain embodiments the protuberances are generally in the form of straight or substantially straight lines arranged in parallel with a single element angle, the invention is not so limited. In other embodiments the protuberances may have a curvilinear shape and a given protuberance may comprise segments having more than one axis of orientation and more than one element angle. Despite having segments with different element angles a given curvilinear protuberance generally has a major axis and may be MD orientated and the protuberance may have a non-zero element angle.

In a particularly preferred embodiment the protuberances are arranged in a continuous twill pattern, extending from a first lateral edge of the fabric to a second lateral edge of the fabric, in which adjacent protuberances are generally parallel to one another. The twill woven protuberances have a non-zero element angle, such as from about −20 about −0.5 degrees or from about 0.5 to about 20 degrees. Of course, the directions of the protuberance alignments refer to the principal alignment of the protuberances. Within each alignment, the protuberance may have segments aligned at other directions, but aggregate to yield the particular alignment of the entire protuberance. Further, while in the instant embodiment the protuberances are continuous, in other embodiments the protuberances may be discrete.

If a papermaking fabric includes multiple protuberances it is contemplated that a plurality of, or all of, the protuberances can be configured substantially the same in terms of any of one or more characteristics of element angle, height, width, or length. For example, substantially all of the protuberances may be MD orientated and have the same element angle and width. In other instances however, the papermaking fabric can be configured with protuberances configured such that one or more characteristics of height, width, or length of the protuberances vary from one protuberance to another protuberance.

Figure 2:
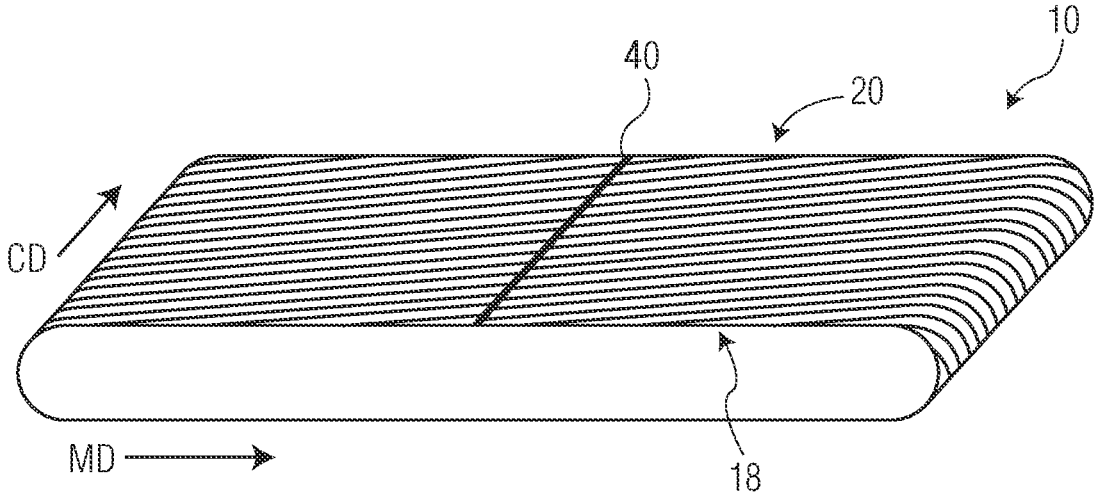
FIG. 2 illustrates the woven papermaking fabric of FIG. 1 in seamed configuration.

With reference now to FIGS. 1 and 2, one embodiment of a papermaking fabric according to the present invention is illustrated. The fabric 10 has two principal dimensions—a machine direction ("MD"), which is the direction within the plane of the fabric 10 parallel to the principal direction of travel of the tissue web during manufacture and a cross-machine direction ("CD"), which is generally orthogonal to the machine direction. The papermaking fabric can include a first longitudinal end 13 and a second longitudinal end 15 that can be joined to form a seam 40 as shown in FIG. 2.

The papermaking fabric generally comprises a plurality of filaments that can be woven together. As will be described in further detail below, the filaments can include a plurality of warp filaments 14 and a plurality of shute filaments 16 that can be woven together to form a machine contacting surface 18 and a web contacting surface 20 of the woven papermaking fabric 10. The web contacting surface 20 can be opposite from the machine contacting surface 18. Machinery employed in a typical papermaking operation is well known in the art and may include, for example, vacuum pickup shoes, rollers, and drying cylinders. In a preferred embodiment, the papermaking fabric comprises a through-air drying fabric useful for transporting an embryonic tissue web across drying cylinders during the tissue manufacturing process. However, in other embodiments, the woven papermaking fabric can comprise a transfer fabric for transporting an embryonic tissue web from forming wires to a through-air drying fabric. In these embodiments, the web contacting surface supports the embryonic tissue web, while the opposite surface, the machine contacting surface, contacts the surrounding machinery.

The web contacting surface 20 of the fabric 10 comprises a plurality of protuberances 22. The protuberances 22 are generally disposed on the web-contacting surface 20 for cooperating with, and structuring of, the wet fibrous web during manufacturing. In a particularly preferred embodiment the web contacting surface 20 comprises a plurality of spaced apart three-dimensional protuberances 22 distributed across the web-contacting surface 20 of the fabric 10 and together constituting from at least about 15 percent of the projected surface area of the web contacting surface of the fabric, such as from about 15 to about 35 percent, more preferably from about 18 to about 30 percent, and still more preferably from about 20 to about 25 percent.

The protuberances 22, such as those illustrated in FIG. 1, may extend generally in a first direction along a major axis 25 across one dimension of the fabric 10 in a continuous fashion. In this manner a protuberance 22 may extend from a first longitudinal edge 15 of the fabric 10 to a second longitudinal edge 13. In such embodiments the length of the protuberance is dependent upon the length of the fabric 10 and the angle of the protuberance relative to the machine direction (MD). For example, the protuberances 22*a*-22*c* may be arranged in a parallel fashion and extend along a major axis 25 at an angle (a) relative to the machine direction axis 27. In this manner the protuberances 22 generally have a long direction axis, i.e., the major axis 25, that intersects the machine direction axis 27 to form an element angle (a), which is preferably greater than about 0.5 degrees, and more preferably greater than about 2.0 degrees and still more preferably greater than about 5.0 degrees, such as from about 0.5 to about 20 degrees and more preferably from about 2.0 to about 15.0 degrees and still more preferably from about 5.0 to about 10.0 degrees. While the illustrated protuberances are arranged in a parallel fashion and have the same element angle, the invention is not so limited. In other embodiments the element angle may vary amongst the protuberances.

With continued reference to FIG. 1, the web-contacting surface 20 comprises a plurality of valleys 24, which are generally bounded by adjacent protuberances 22*a*, 22*b* and coextensive with the upper surface plane of the fabric 10. In the illustrated embodiment the valleys 24, like the protuberances 22 are continuous and extend across the plane of the fabric diagonally from a first lateral edge 17 to a second fabric edge 19. The valleys 24 are generally permeable to liquids and allow water to be removed from the cellulosic tissue web by the application of differential fluid pressure, by evaporative mechanisms, or both when drying air passes through the embryonic tissue web while on the papermaking fabric 10 or a vacuum is applied through the fabric 10. Without being bound by any particularly theory, it is believed that the arrangement of protuberances and valleys allow the molding of the embryonic web causing fibers to deflect in the z-direction and generate the caliper of, and patterns on the resulting tissue web.

Figure 3:
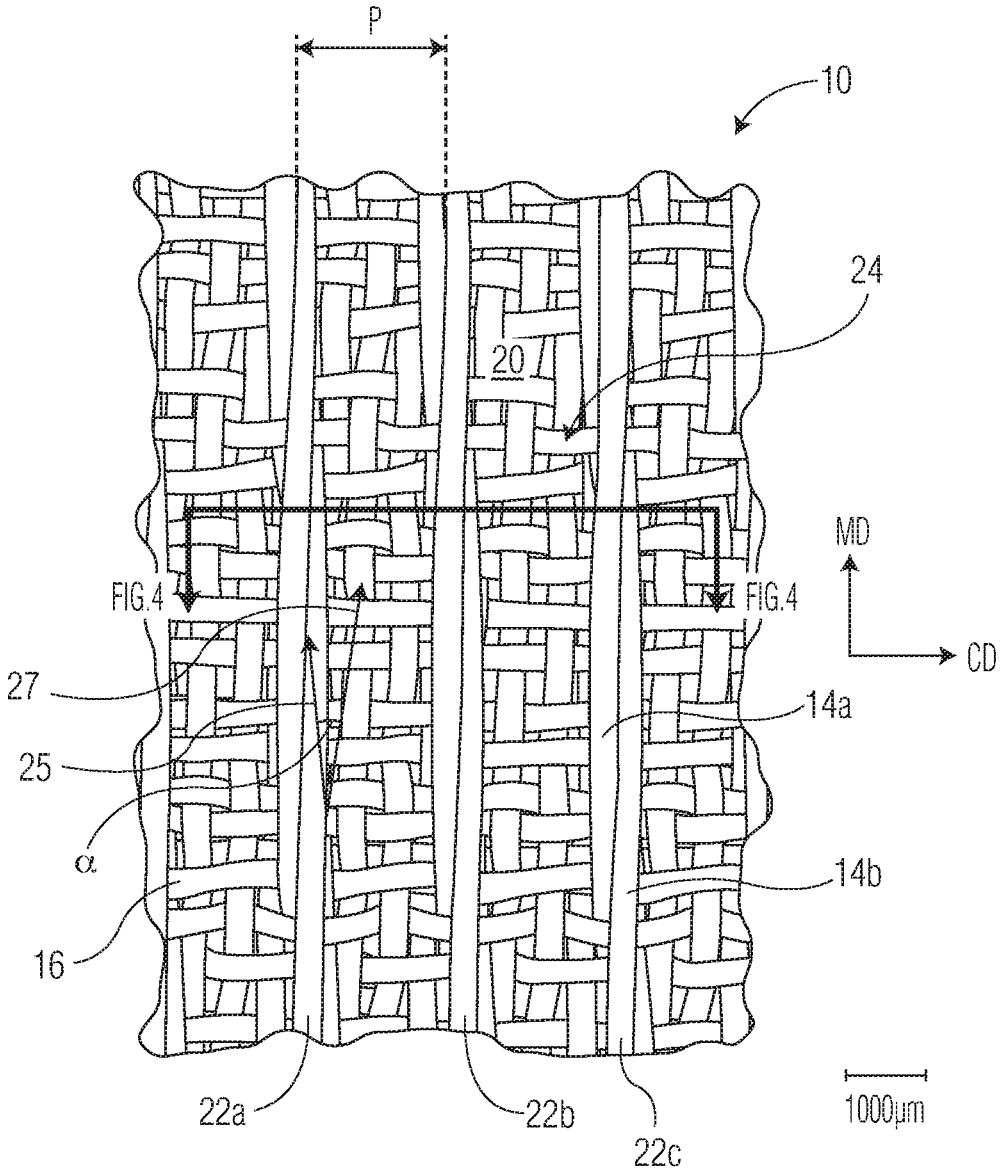
FIG. 3 is a top view of a woven papermaking fabric having a three-dimensional fabric contacting surface according to one embodiment of the present invention.
Figure 4:
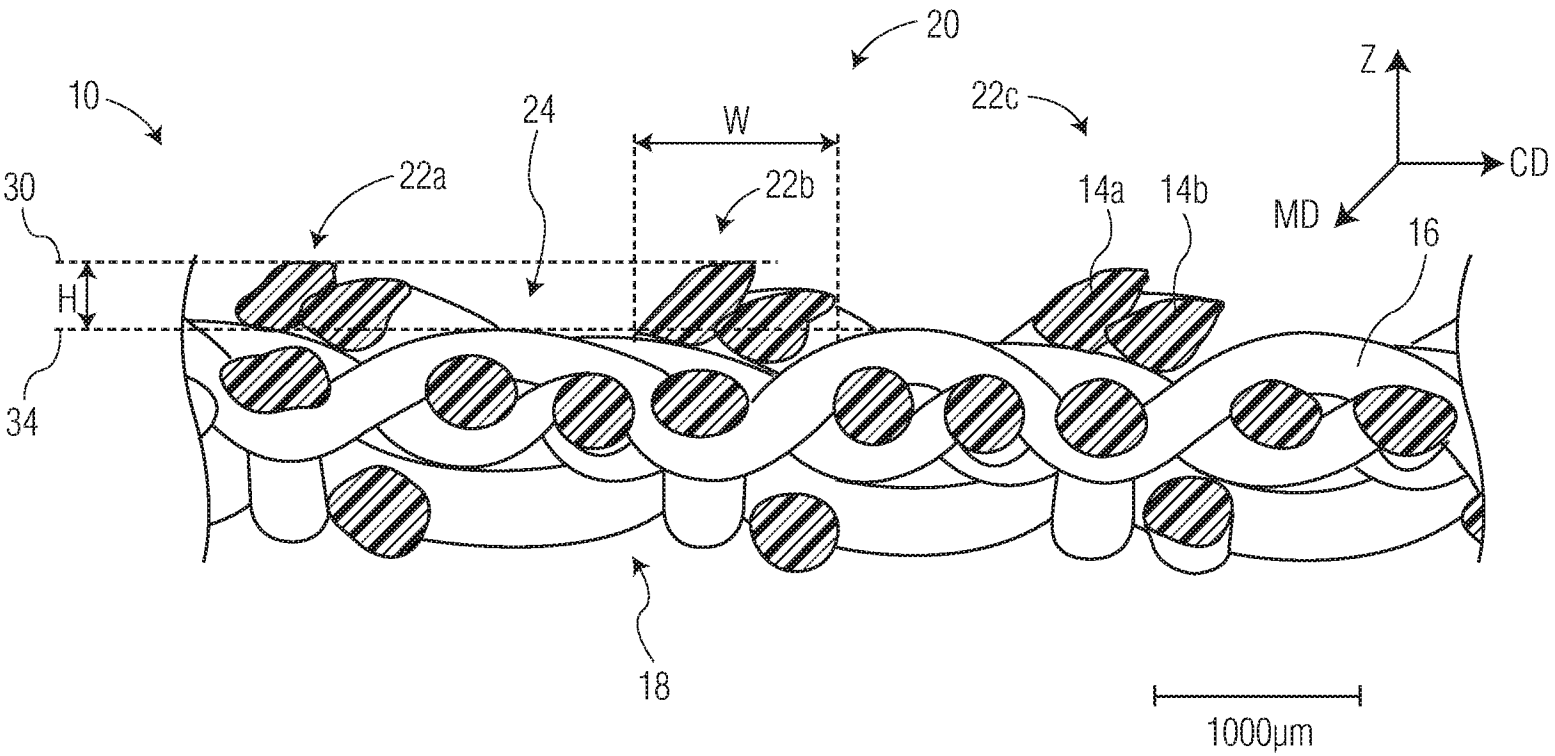
FIG. 4 is a cross-section view of the fabric of FIG. 3 through the line 4-4.

With reference now to FIGS. 3 and 4, the fabric 10 is woven from a plurality interwoven of shute and warp filaments 14, 16 and has a web contacting surface 20 with a plurality of MD orientated protuberances 22*a*-22*c*. The MD orientated protuberances 22*a*-22*c* are spaced apart from one another in the CD and define a plurality of valleys 24 there between, which are also interwoven of shute and warp filaments 14, 16.

The protuberances 22 may be formed from a pair of tightly woven warp filaments 14*a*, 14*b*. The warp filaments can vary in length, but typically rise over from about five to about fifty, such as from about ten to about thirty shute filaments, depending on the size and spacing of the shute filaments. The pair of warp filaments 14*a*, 14*b* forming a given protuberance 22 overlap one another to a certain extent allowing the end of one warp float 14*a* to tuck under the next machine direction oriented warp float 14*b*. In this manner the protuberances 22*a*-22*c* are formed from a pair of warps 14*a*, 14*b* stacked on top of one another in a uniform fashion. As the warps 14*a*, 14*b* tuck under one another they provide the protuberance 22 with a height (H) and form a twill pattern having a twisted rope appearance. The illustrated protuberances generally have a height from about 1.0 to about 2.5 mm.

Figure 5:
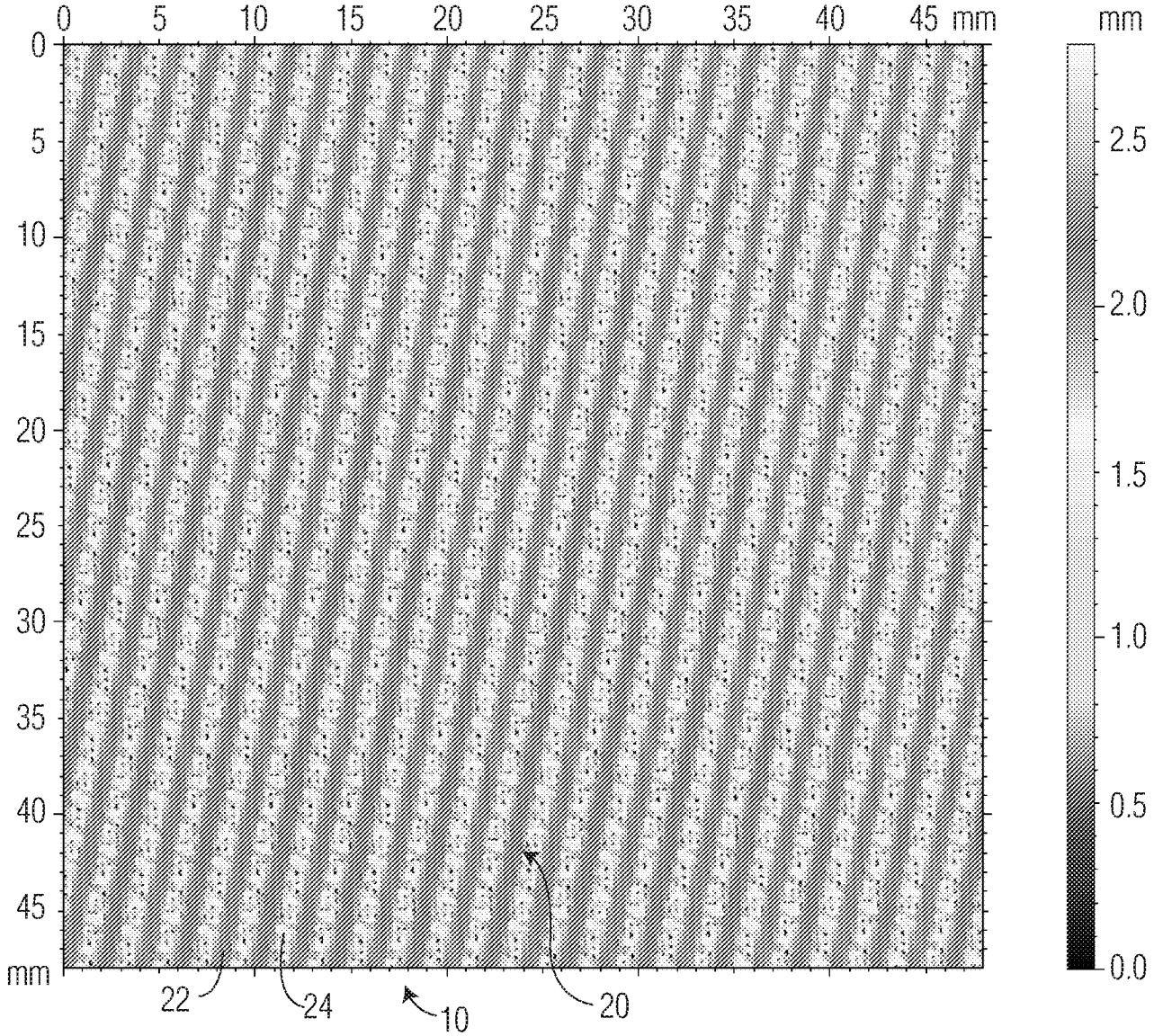
FIG. 5 is a profilometry scan of the fabric depicted in FIG. 3.

As shown in FIG. 4, the protuberances 22 generally extend in the z-direction (generally orthogonal to both the machine direction and cross-machine direction) above the valley bottom plane 34 and form an upper surface plane 30. It is generally preferred that the woven fabrics of the present invention comprise protuberances having an upper surface that is substantially planar such that the protuberances have a relatively uniform height. For example, as shown in the profilometry scans of FIG. 5, the MD orientated protuberances 22 are the highest points on the web contacting surface 20 of the fabric 10 and define valleys 24 there between. The MD orientated protuberances 22 have a substantially planar upper surface and their height is relatively uniform along their length.

Accordingly, for a given protuberance the upper surface plane extends uninterrupted for the length of the protuberance. For example, where a protuberance is continuous and extends throughout one dimension of the papermaking fabric its upper surface plane is preferably uninterrupted along the entire length to provide a single protuberance with a substantially continuous height along its length. While it is generally desirable that the height of a protuberance be substantially constant along its length, slight height variances can be expected as a result of the protuberances being formed from woven filaments. For example, it may be desirable that the height of a given protuberance vary less than ±150 μm and more preferably less than about ±100 μm along its length. To ensure that the height of a given protuberance is substantially constant along its length, it may be preferable to weave the protuberances from one or more warp filaments without inspecting or interrupting the one or more warp filaments with shute filaments.

The shape of the protuberances, such as the height, width and cross-sectional shape, may vary depending on the size, shape and number of warp filaments that make up the protuberance. For example, as illustrated in FIG. 4, a pair of warp filaments 14*a*, 14*b* are bundled together to form a protuberance 22 having a semi-circular cross-sectional shape having an upper surface plane 30 that lies above the valley bottom plane 34 in the z-direction providing the protuberance 22 with a height (H). In certain instances the height of the protuberances may be altered by selecting warp filaments of different sizes and shapes and by the number of warps forming a given protuberance.

The protuberance height (H) can be varied, such as from about 0.1 to about 5.0 mm, more preferably from about 0.2 to about 3.0 mm, or even more preferably from about 0.5 to about 1.5 mm. Of course, it is contemplated that the height can be outside of this preferred range in some embodiments. Further, while the height of the protuberances is generally illustrated herein as being substantially uniform amongst the protuberances, the invention is not so limited and the protuberances may have different heights.

The protuberance width (W) may also vary depending on the construction of the fabric and its intended use. For example, the width of the protuberances may be influenced by the number of warp filaments used to form the protuberance, as well as the diameter of the filament used for a given warp float. In certain embodiments a protuberance may comprise from 2 to 8, such as 4 to 6, warp filaments. In other instances the warp filaments may have a diameter from about 0.2 to about 0.7 mm, such as from about 0.3 to about 0.5 mm and the protuberances may be woven from 2 to 6 adjacent warp filaments.

In one embodiment the protuberance may have a square cross-sectional shape, where the width (W) and height (H) are substantially equal and vary from about 0.5 to about 3.5 mm, more preferably from about 0.5 to about 1.5 mm, and in a particularly preferred embodiment between from about 0.7 to about 1.0 mm. However, it is to be understood that because the protuberance is formed from woven filaments having generally circular or oval cross-sectional shapes, the cross-sectional shape of the resulting protuberance may not be perfectly rectilinear, but may have some other cross-sectional shape that is approximately rectilinear.

Protuberance width (W) is generally measured normal to the principal dimension of the protuberance in a plane defined by the cross-machine direction (CD) at a given location. Where the protuberance has a generally square or rectangular cross-section, the width is generally measured as the distance between the two planar sidewalls that form the protuberance. In those cases where the protuberance does not have planar sidewalls the width is measured at the point that provides the greatest width for the configuration of the protuberance. For example, the width of a protuberance not having two planar sidewalls may be measured along the base of the protuberance. In some preferred embodiments, the protuberances may have a width greater than about 0.5 mm, such as from about 0.5 to about 3.5 mm, more preferably from about 0.5 to about 2.5 mm, and in a particularly preferred embodiment between from about 0.7 to about 1.5 mm. In certain instances the protuberance may have a substantially square cross-sectional area such that the width and height are substantially equally, such as a height and a width from about 1.0 to about 2.0 mm. Of course, it is contemplated that the width and height can be outside of the preferred range in some embodiments and still be within the scope of this disclosure.

Figure 6:
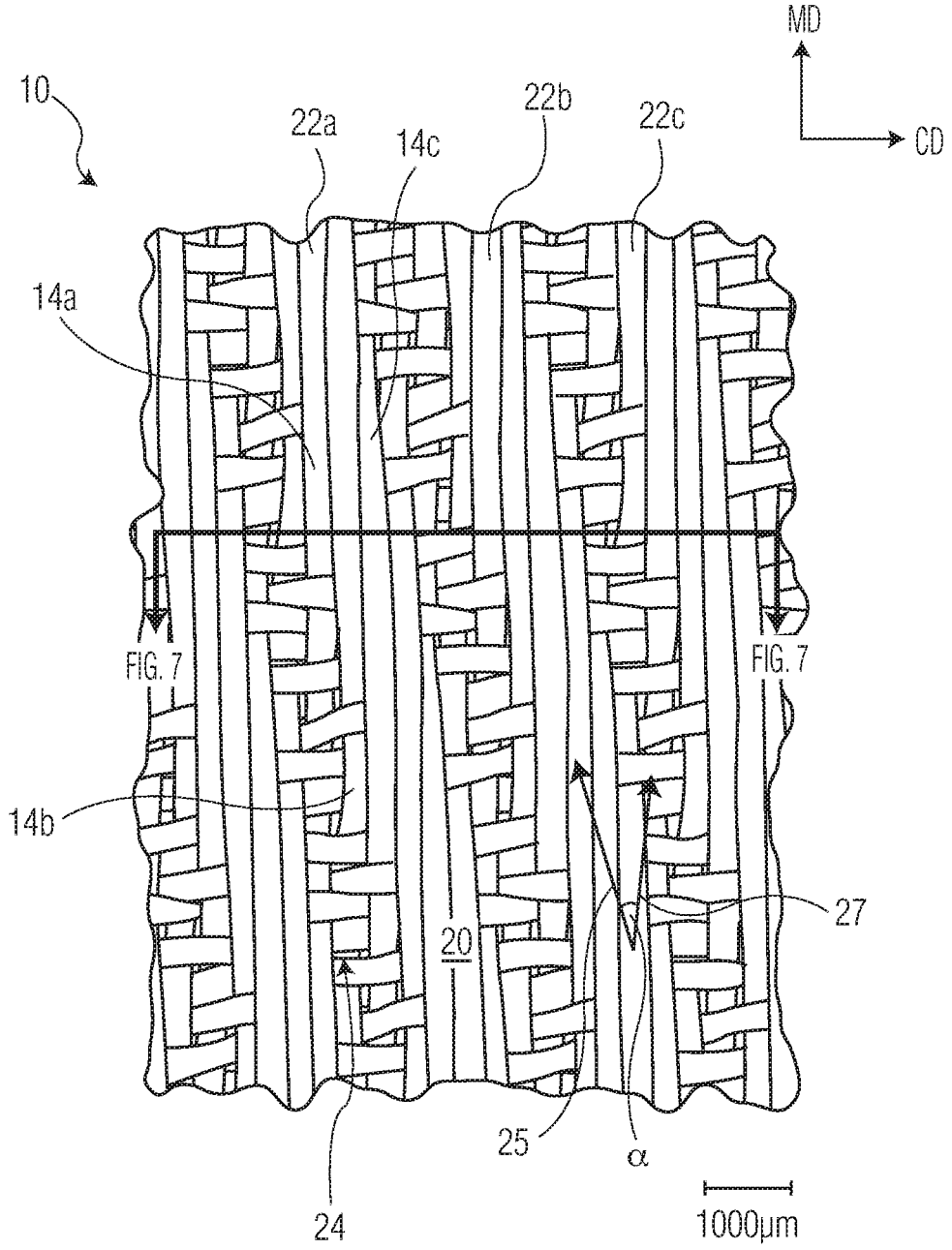
FIG. 6 is a top view of a woven papermaking fabric having a three-dimensional fabric contacting surface according to another embodiment of the present invention.
Figure 7:
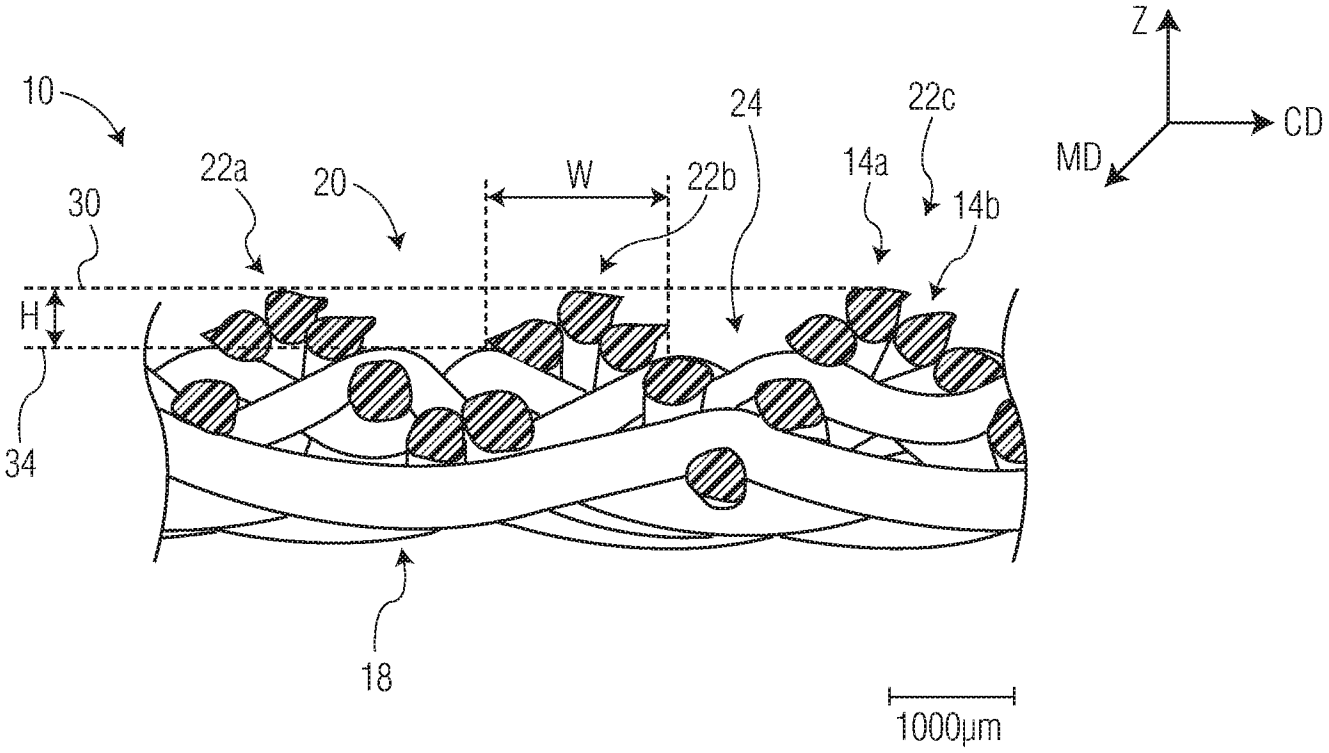
FIG. 7 is a cross-section view of the fabric of FIG. 6 through the line 7-7.

With reference now to FIGS. 6 and 7, the fabric 10 may comprise a plurality of protuberances 22*a*-22*c* disposed on the web contacting surface 20. The protuberances 22*a*-22*c* are each formed from three warp filaments 14*a*-*c*. The protuberances 22*a*-22*c* are arranged generally parallel to one another and extend in a continuous fashion along a first major axis 25, which lies at an element angle (a) relative to the MD axis 27. The protuberance 22 generally comprises a top surface lying in an upper surface plane 30 (shown in FIG. 7). Generally the portions of the warp filaments 14 forming the protuberances 22 are the highest points on the surface of the fabric 10 and define a second fabric surface plane 30. The second fabric surface plane 30 generally lies above the valley bottom plane 34. The adjacent protuberances 22*a*, 22*b* generally define a valley 24 there between.

The present fabrics may be woven such that the valleys are relatively deep. For example, in certain instances the valleys may have a valley depth greater than about 0.30 mm, more preferably greater than about 0.35 mm and still more preferably greater than about 0.40 mms, such as from about 0.30 to about 1.0 mm. Further, in certain instances, the valley walls formed by adjacent protuberances may be relatively steep, such as wall angles greater than about 20 degrees and more preferably greater than about 22 degrees and still more preferably greater than about 24 degrees, such as form about 20 to about 45 degrees and more preferably from about 22 to about 40 degrees.

The spacing and arrangement of protuberances may vary depending on the desired tissue product properties and appearance. If the individual protuberances are too high, or the valley area is too small, the resulting sheet may have excessive pinholes and insufficient compression resistance, CD stretch, and CD Tensile Energy Absorption (TEA), and be of poor quality. Further, tensile strength may be degraded if the span between protuberances greatly exceeds the fiber length. Conversely, if the spacing between adjacent protuberances is too small the tissue will not mold into the valleys without rupturing the sheet, causing excessive sheet holes, poor strength, and poor paper quality.

For example, the spacing and arrangement of protuberances may be arranged so as to provide fabrics having a relatively large percentage of fabric contacting surface formed from valleys disposed between adjacent protuberances. The valley width, which is generally measured using profilometry as described herein may be greater than about 1.0 mm, more preferably greater than about 1.5 mm and still more preferably greater than about 2.0 mm, such as from about 1.5 to about 3.5 mm. Of course, it is contemplated that the width can be outside of the preferred range in some embodiments and still be within the scope of this disclosure.

In other instances the woven fabric may comprise continuous, similarly shaped and spaced protuberances arranged to form continuous valleys there between. The protuberances may have a width from about 0.5 to about 2.5 mm and the valleys may have a width from about 1.5 to about 3.5 mm In certain instances the valleys may be a predominate feature on the fabric surface and may comprise greater than about 50 percent, more preferably greater than about 55 percent, such as from about 50 to about 75 percent of the projected area of the web contacting surface of the fabric.

In a particularly preferred embodiment the protuberances are MD orientated and woven in a twill pattern defining continuous valleys there between, the valleys having a width from about 1.0 to about 4.0 mm and a depth greater than about 0.30 mm and more preferably greater than about 0.40 mm and relatively steep wall angles, such as greater than about 20 degrees and more preferably greater than about 22 degrees and still more preferably greater than about 24 degrees, such as from about 20 to about 45 degrees and more preferably from about 22 to about 40 degrees.

Several exemplary woven papermaking fabrics are illustrated in the attached figures. The illustrated fabrics are woven so as to form a plurality of angled MD oriented protuberances having valleys disposed there between and may be useful in the manufacture of tissue products, particularly the manufacture of through-air dried tissue products. The illustrated fabrics generally have valley depths greater than about 0.30 mm, more preferably greater than about 0.35 mm and still more preferably greater than about 0.40 mms, such as from about 0.30 to about 1.0 mm. The fabrics are woven such that the valleys have relatively steep sidewalls, such as a wall angle greater than about 20 degrees and more preferably greater than about 22 degrees and still more preferably greater than about 24 degrees, such as from about 20 to about 45 degrees and more preferably from about 22 to about 40 degrees. The dimensions of various papermaking fabrics prepared according to the present invention are summarized in the table below.

TABLE 1

Figure 8A:
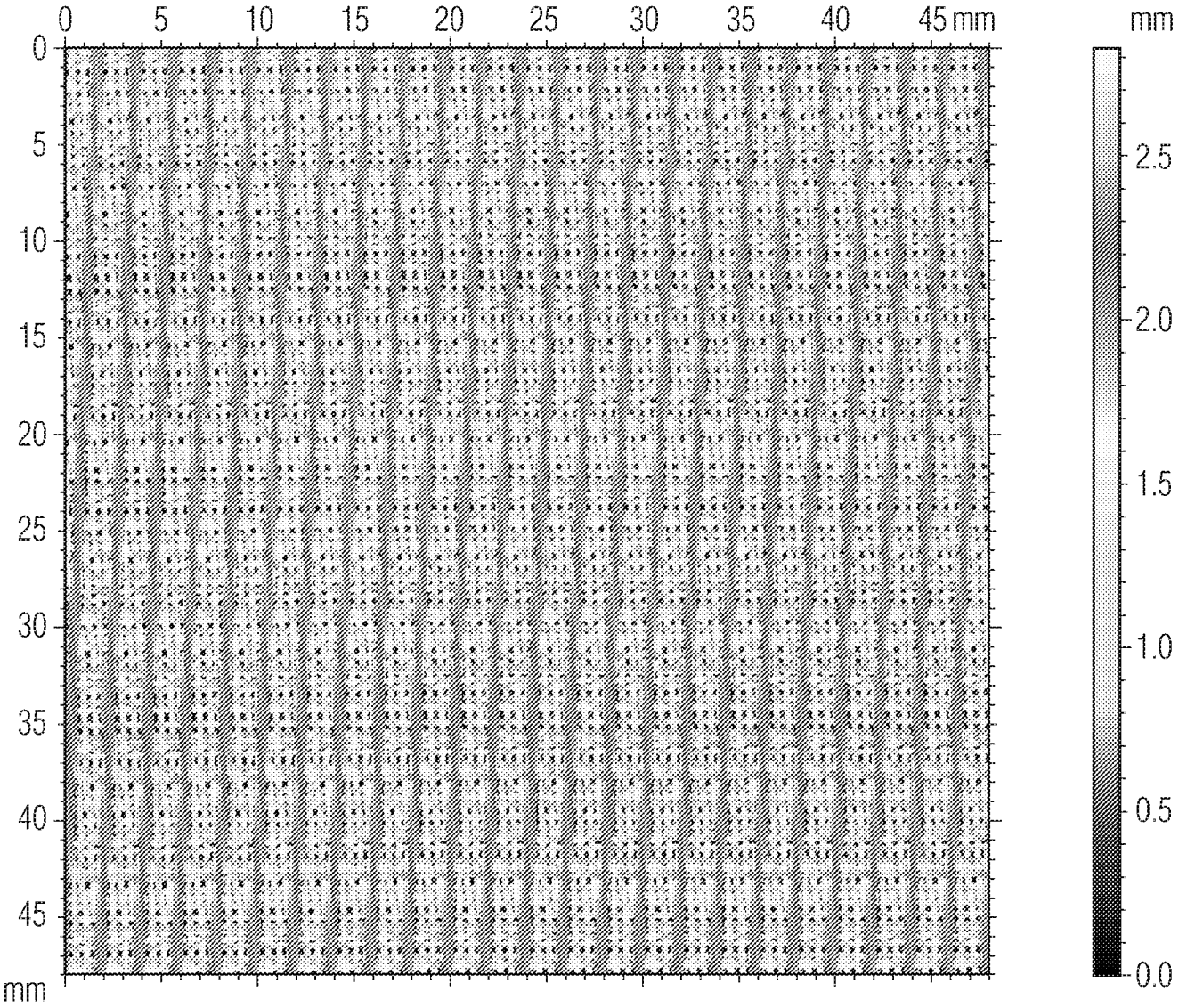
FIG. 8A-8C are images and analysis of a fabric according to one embodiment of the present invention generated by a profilometer as described in the Test Methods section below.
Figure 8B:
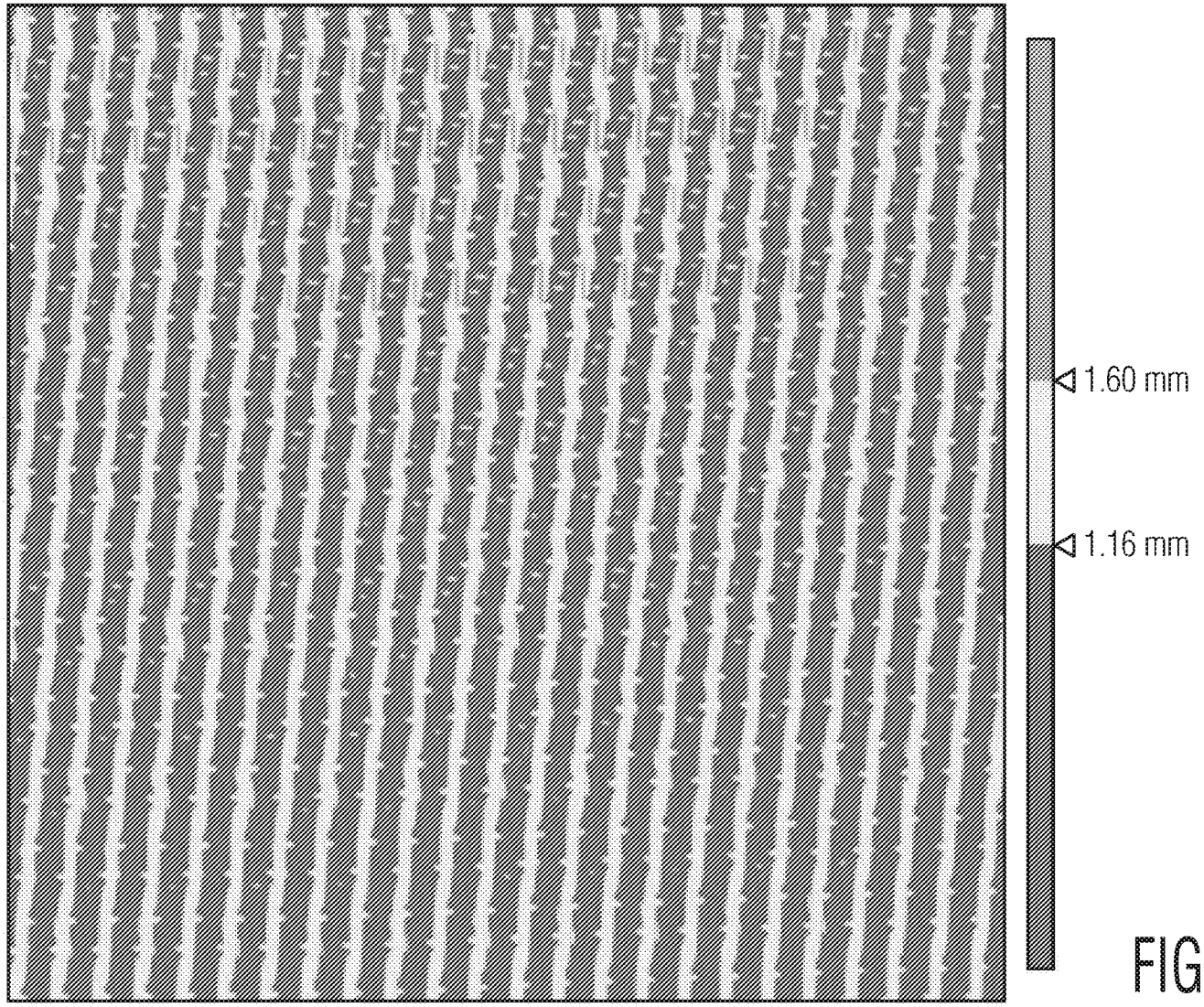
Figure 8C:
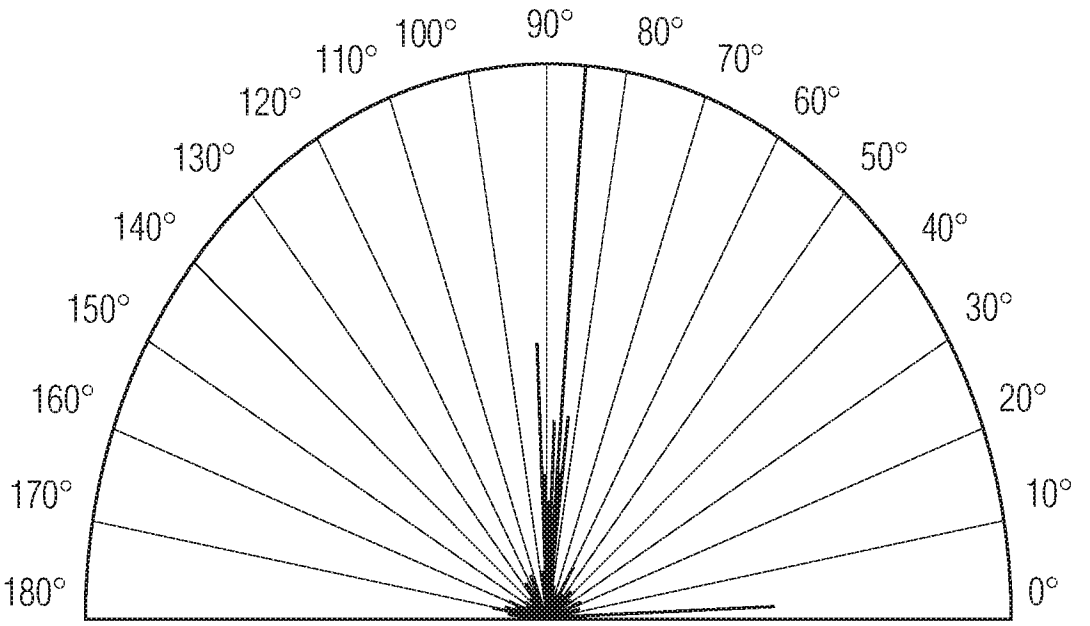
Figure 10A:
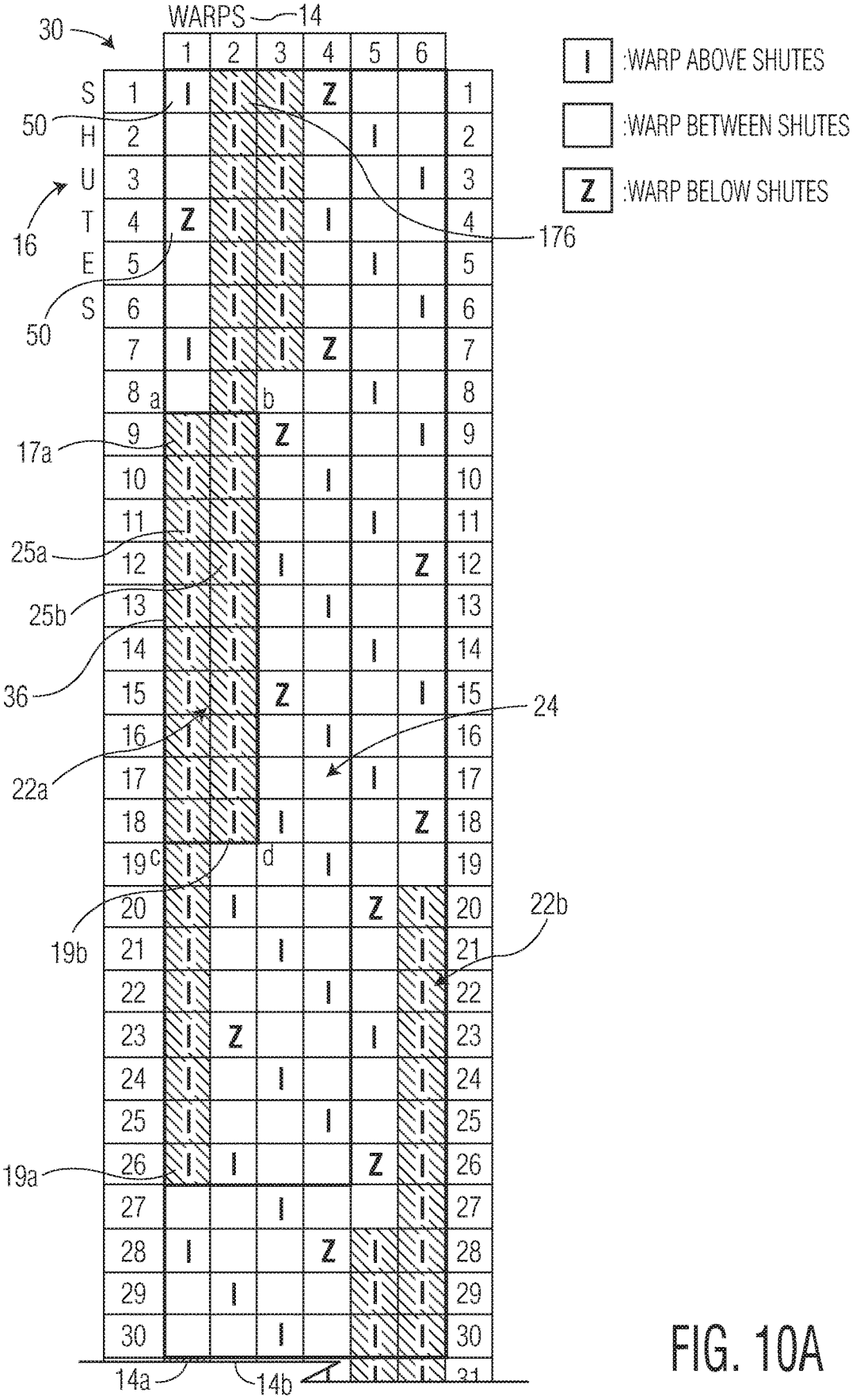

| Illustrated Fabric | Valley Depth (mm) | Wall Angle (°) | Valley Width (mm) | Element Angle (°) | Valley Volume (%) |
|---|---|---|---|---|---|
| FIG. 8A | 0.409 | 24.6 | 2.01 | 4.8 | 65 |
| FIG. 10A | 0.363 | 22.6 | 2.03 | 6.3 | 64 |

Exemplary weave patterns and methods of manufacturing a woven papermaking fabric will now be described. In one embodiment, the papermaking fabric could be manufactured by providing a first set of filaments and a second set of filaments that are woven in a weave pattern. The first set of filaments can serve as warp filaments in a loom and the second set of filaments can serve as shute filaments in a loom. The method can additionally include weaving the shute filaments with the warp filaments in a lateral direction to provide a web contacting surface of the woven papermaking fabric and a machine contacting surface of the woven papermaking fabric and to provide a plurality of MD oriented protuberances in a twill pattern and a plurality of valleys disposed there between on the web contacting surface of the woven papermaking fabric. Weaving the shute filaments with the warp filaments can be accomplished according to following a weave patterns.

Figure 11A:
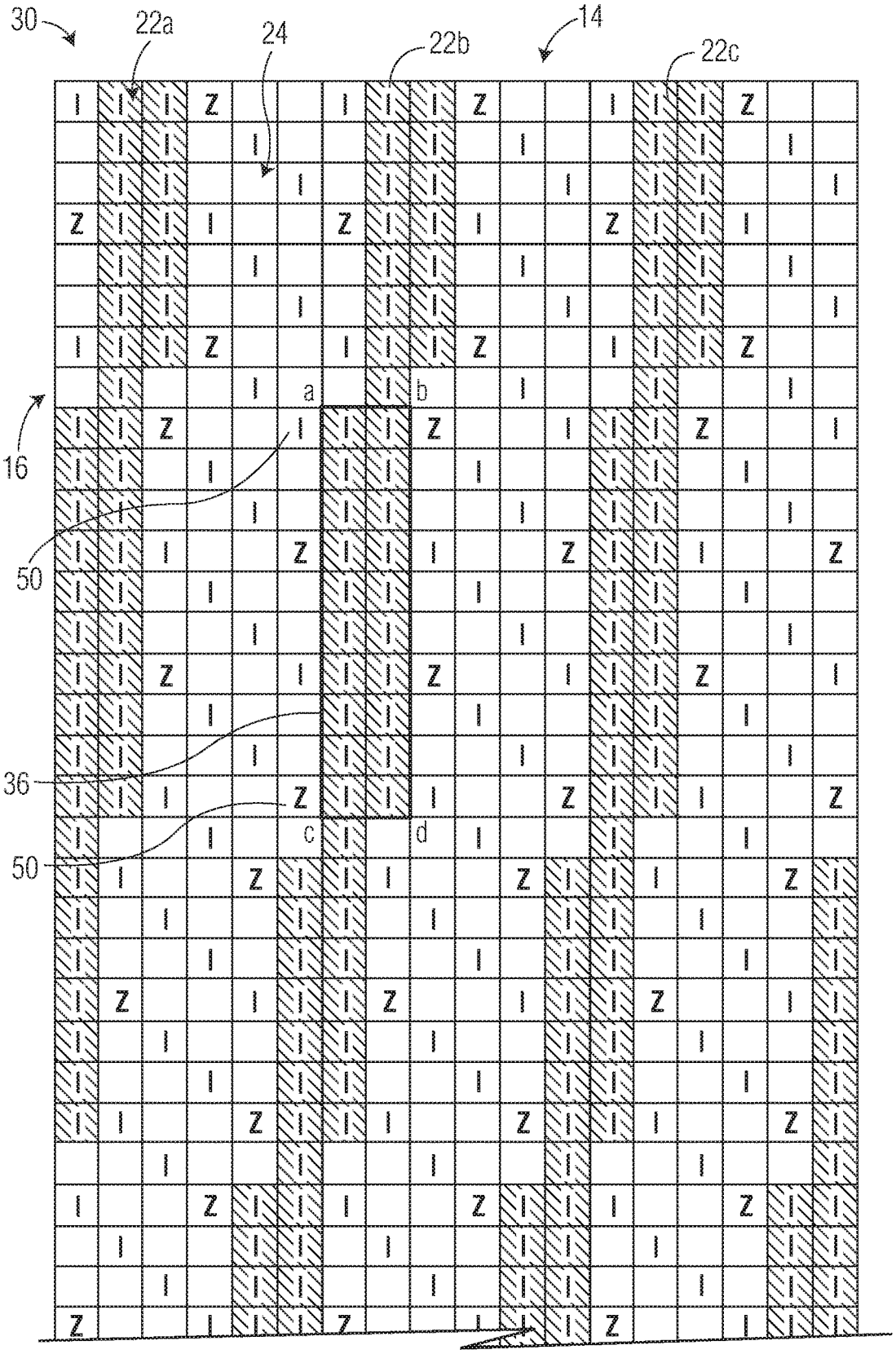
FIG. 11A-11B illustrates one weave pattern useful in the manufacture of a woven papermaking fabric according to the present invention.
Figure 11B:
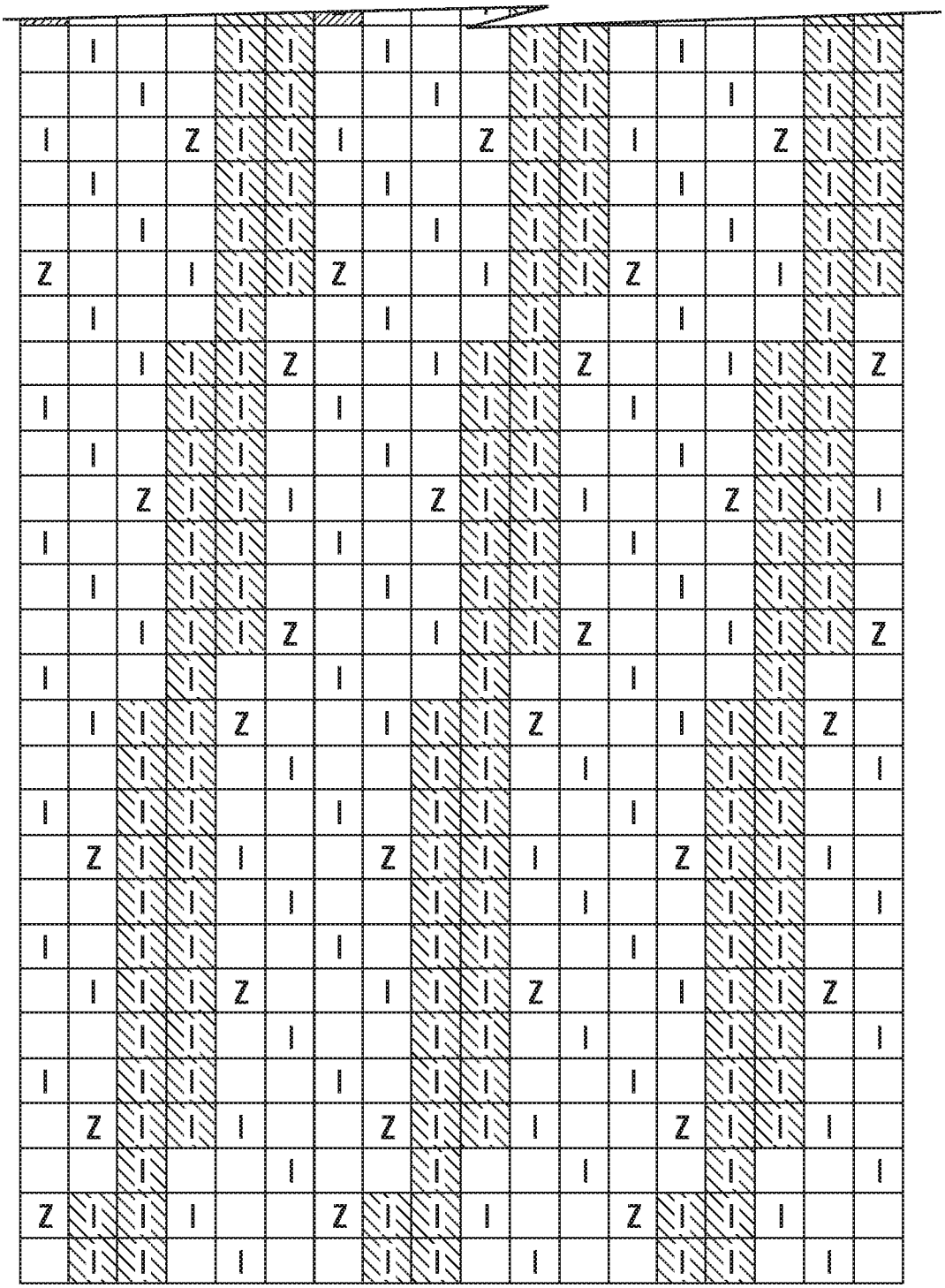

Various weave patterns can be used to guide the weaving of the shute filaments with the warp filaments and provide machine direction oriented protuberances that are stabilized on the papermaking fabric. One exemplary weave pattern 30 is shown in FIGS. 10A and 10B. Generally FIG. 10A defines an entire unit cell, which may be combined with other unit cells to form a weave pattern according to the present invention. Unit cells can be repeated as many times as desired in the machine direction and/or the cross-machine direction to form a desired pattern in a papermaking fabric. As an example, the unit cell of FIG. 10A may be repeated and combined to create the weave pattern 30 illustrated in FIGS. 11A and 11B. The pattern of FIGS. 11A and 11B is just one way the unit cell of FIG. 10A may be combined and arranged to create a weave pattern for a papermaking fabric and the skilled artisan will be able to envision alternate means of arranging the unit cell to create a papermaking fabric having a pattern.

The weave pattern 30 of FIGS. 10A and 10B will now be described in detail, however, the principles of weave pattern 30 may be adapted to form a broad range of unit cells that may be combined to form a twill pattern according to the present invention. The weave pattern 30 can include a plurality of warp filaments 14 generally aligned in the machine direction (MD) and a plurality of shute filaments 16 generally aligned in the cross-machine direction (CD). The weave pattern 30 can be configured on a loom (not pictured) such that the web contacting surface 20 of the papermaking fabric 10 (as labeled in FIG. 2) will be facing out from the page, and the machine contacting surface 18 of the papermaking fabric 10 (as labeled in FIG. 2) will be facing into the page. Of course, it is contemplated that a weave pattern 30 could be configured in the opposite orientation on a loom. Each interchange of a specific warp filament 14 and a specific shute filament 16 of the weave pattern 30 that includes a vertical line segment (or a capital letter "I") provides a notation that the warp filament 16 is above top shute (and above bottom shute if present) at that interchange. For example, the interchange of warp filament No. 1 and shute filament No. 1 includes such a vertical line segment in FIG. 10A, and thus, warp filament No. 1 is woven above shute filament No. 1. In some circumstances interchanges of warp filaments 14 and shute filaments 16 that have the vertical line segment (or capital letter "I") that will lead to the development of a protuberance 22 are also shaded with a cross-hatching pattern for purposes of clarity of perceiving the protuberances 22 of the weave pattern 30 provided herein. In other instances a row in the unit cell contains a square containing a "Z", which indicates that two shutes are represented by the row. A web contacting shute and a machine contacting shute are both represented. The web contacting shute assumes that the interchange containing a "Z" is treated as an I. The machine contacting shute assumes that all interchanges except a "Z" are treated as blank. In still other instances where a specific warp at a given interchange is woven below the top shute (and above bottom shute if present) the pattern 30 is left blank.

The weave pattern 30 is configured with machine direction oriented warp filaments 14 woven with cross-machine oriented shute floats 16 to form protuberances 22. Generally protuberances 22 are continuous areas in the weave pattern 30 in which a plurality of adjacent warp/shute filament interchanges are woven such that the warp filaments 14 are woven above their respective shute filaments 16. Protuberances 22 can be of various lengths and/or widths to provide various shapes. As shown in FIG. 10A, the weave pattern 30 includes a first machine direction oriented protuberance 22*a* which forms a generally linear segment in shape and is spaced apart from a second similarly shaped protuberance 22*b*.

Between the first and second protuberances 22*a*, 22*b* a valley 24 is formed. The width of the valley, measured generally in the cross-machine direction, may be from two to ten, such as from four to six, warps wide. In the embodiment illustrated in FIGS. 10A and 10B, the valley 24 is four warps wide. The valley may comprise a variety of different weave patterns to stabilize the resulting fabric and increase the height of the protuberances. For example, the valley 24 of FIGS. 10A and 10B comprises warp/shute filament interchanges in which the warp filaments 14 are woven both above and below their respective shute filaments 16.

The machine direction (MD) oriented protuberance 22*a*, 22*b* each comprise a first 14*a* and a second 14*b* warp filament arranged in a pair-wise fashion. The pair-wise warp filaments 14*a*, 14*b* are directly adjacent warps (illustrated as warp positions Nos. 1 and 2) in the weave pattern 30 and comprise a protuberance forming portion 25*a*, 25*b* in which the warp filament 14*a*, 14*b*, is woven above its respective shute filament. Further, each protuberance forming portion 25 has a first proximal end 17 and first distal end 19 spaced apart in the machine direction (MD). Looking at a specific warp filament 14*a* within the weave pattern 30 in a top-to-bottom fashion, the float proximal end 17*a* can be the interchange of a specific shute filament and a specific warp filament that begins a series of adjacent interchanges in which the warp filaments are woven above that specific shute filament. The float distal end 19*a* can be the interchange of a specific shute filament and a specific warp filament that ends a series of adjacent interchanges in which the warp filaments are woven above that specific shute filament. In other words, a shute filament float proximal end can be where the shute filament is woven from the web contacting surface to the machine contacting surface of the fabric and a shute filament float distal end can be where the shute filament is woven from a machine contacting surface to the web contacting surface of the fabric.

As further illustrated in FIGS. 10A and 10B, the weave pattern 30 is configured such that the pair of warp filaments 14*a*, 14*b* overlap one another along a portion of the protuberance 22*a*. The overlap portion, outlined by the box labeled as 36, is referred to herein as a "paired portion" and comprises a portion of the protuberance 22*a* where both the first and second filaments 14*a*, 14*b* are woven above the corresponding shute filament. In the illustrated embodiment the paired portion 36 has a float length of ten (traversing shute position Nos. 9-18).

In addition to a paired portion 36, the protuberance 22 comprises a portion where adjacent warp filaments are not both woven above their corresponding shute filament. For example, with reference to protuberance 22*a*, warp filament 14*b* includes a single interchange where the protuberance 22*a* comprises a single warp filament woven above the corresponding shute filament.

The length of the protuberance forming portions of the warp filaments, that is the portion of a warp filament woven above the shute floats to form a protuberance, may vary. For example, the warp shutes forming the protuberance may have a float length greater than 4, such as from 4 to 50, more preferably from 5 to 30 and still more preferably from 7 to 20. Further, the vertical, or machine direction, distance between the proximal end of a first protuberance forming portion of a warp filament and the distal end of a second, adjacent, protuberance forming portion of a warp filament may vary in different embodiments. For example, in certain embodiments, float length between the proximal end of a first warp and the distal end of directly adjacent warp may be twenty-five such as that shown in FIGS. 10A and 10B. In other embodiments, float length between the proximal end of a first warp filament and the distal end of a second directly adjacent warp filament may be from twenty to sixty, such as from twenty-five to fifty.

While the number of shute floats traversed by a given protuberance forming warp filament may vary, it is generally preferred that the protuberance be formed from two or more directly adjacent warp filaments and that the distal end of a first warp filament be offset from the proximal end of a second, adjacent, warp filament so as to form a paired portion. The paired portion preferably has a float length of at least two and more preferably at least three, and still more preferably at least four, such as from two to twenty and more preferably from two to fourteen and still more preferably from four to ten.

With reference to FIGS. 11A and 11B the weave pattern 30 further comprises banding 50 which may be used to further increase the z-directional displacement of the warp filaments 14 forming the protuberances 22. With specific reference to protuberance 22*b*, which has a paired portion 36 (circumscribed by the box abcd) having a first end and a second end. A pair of bands 50 are disposed at the first and second ends. The bands 50 comprise a first directly adjacent (in the cross-machine direction) stitch in which the interchange of warp and shute filaments comprises a warp filament above the shute float and a second directly adjacent stitch in which the interchange of warp and shute filaments comprises a warp filament below the shute float. The weave pattern 30 may further comprise third and fourth bands disposed approximately along the paired portion 36.

Figure 9A:
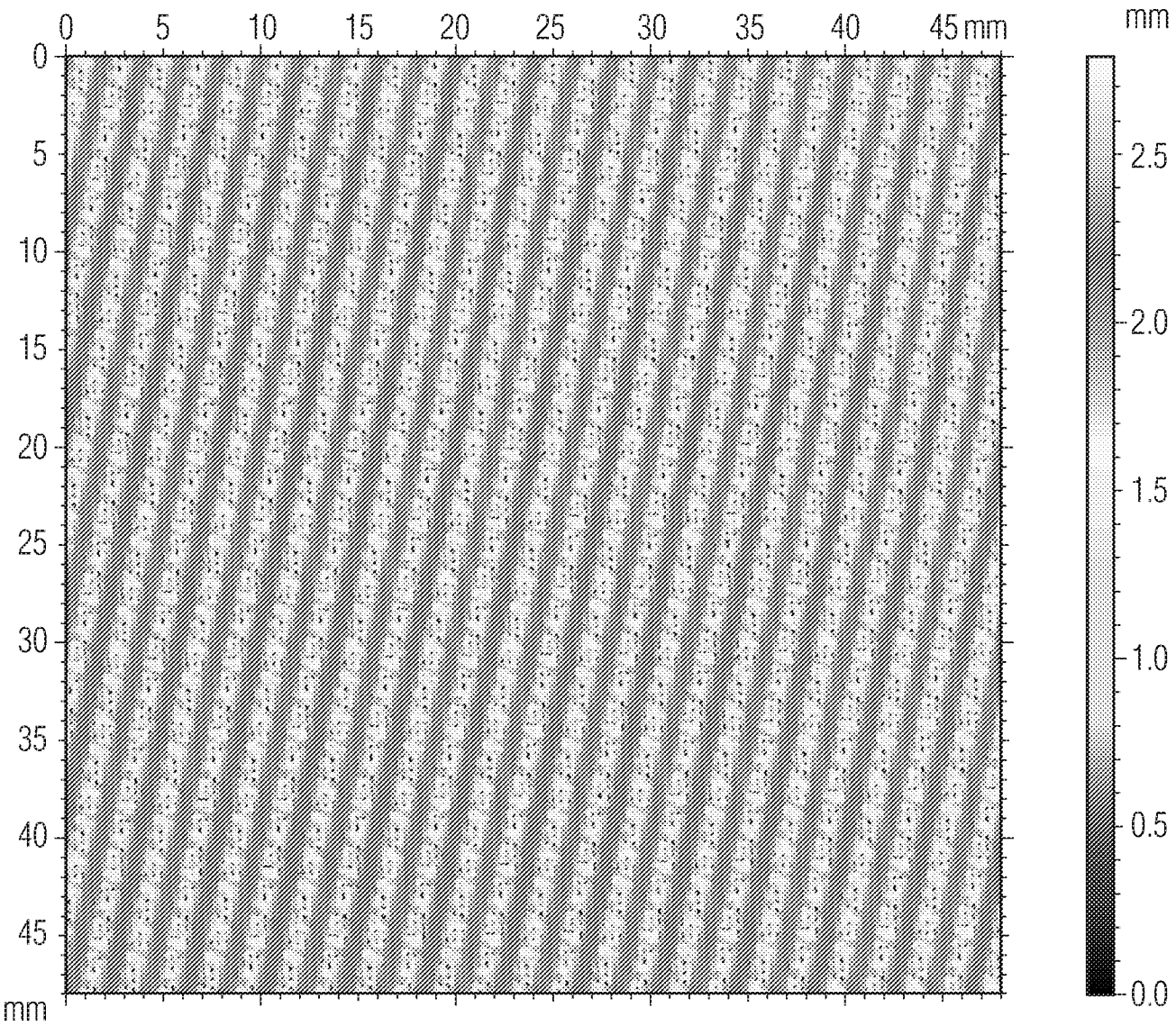
FIG. 9A-9C are images and analysis of a fabric according to another embodiment of the present invention generated by a profilometer as described in the Test Methods section below.
Figure 9B:
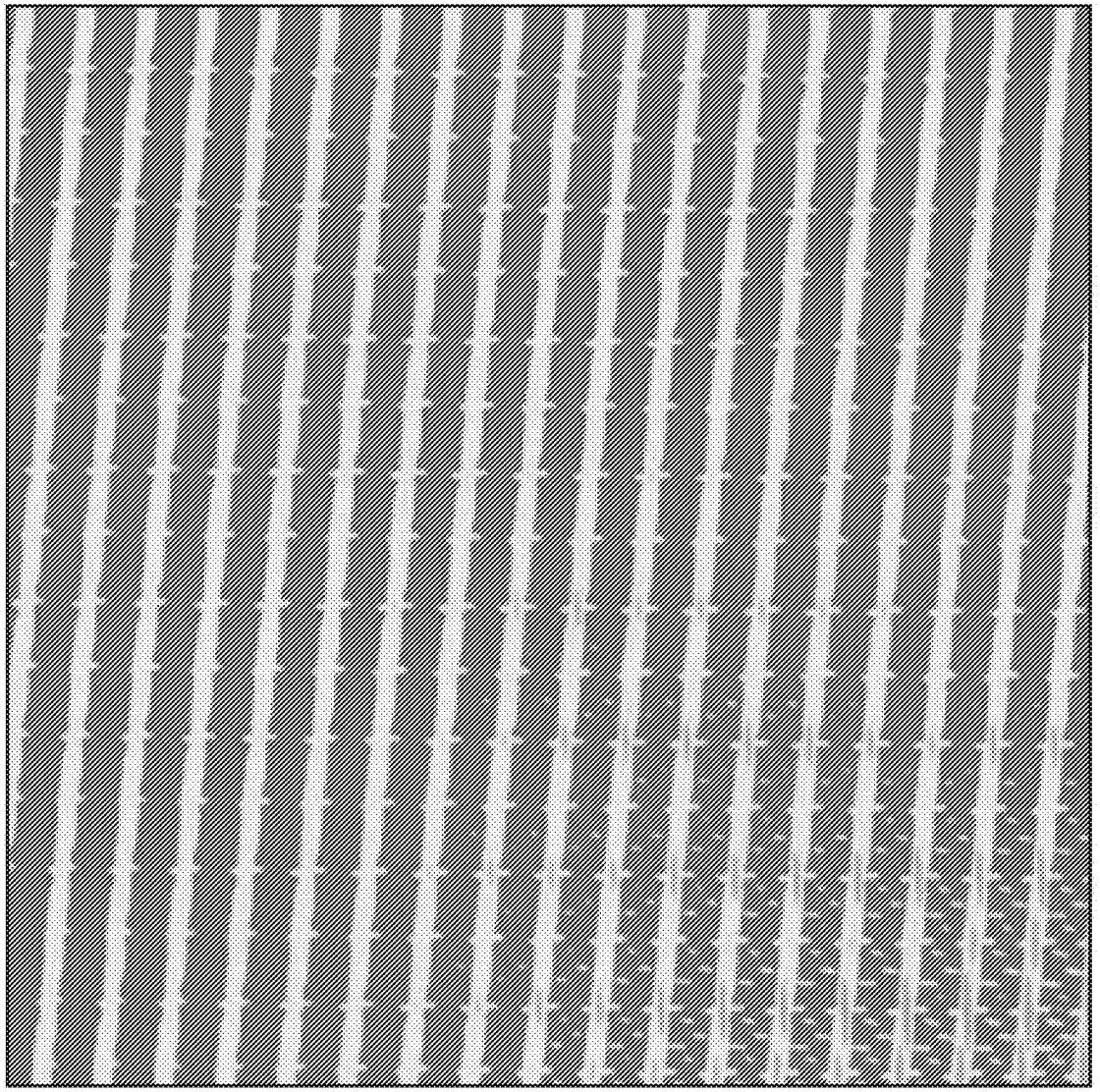
Figure 9C:
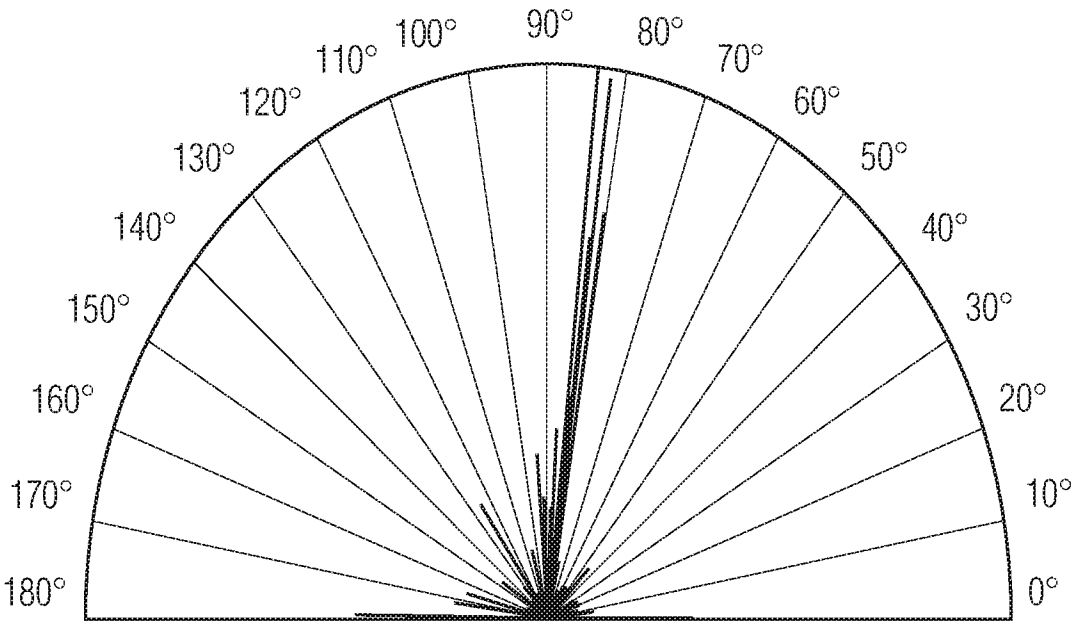

While certain inventive weave patterns, such as those illustrated in FIGS. 9 and 10, incorporate banded protuberances, the invention is not so limited and in certain embodiments a protuberance may be woven without bands. In other embodiments, bands may be woven such that a paired portion comprises only a single band. In still other embodiments a paired portion may comprise two or more bands where at least one of the bands is disposed at the first end of the paired portion. The band may comprise a first directly adjacent (in the cross-machine direction) stitch in which the interchange of warp and shute filaments comprises a warp filament above the shute float and second directly adjacent stitch in which the interchange of warp and shute filaments comprises a warp filament below the shute float. In other embodiments the first and second directly adjacent stitches may both comprises a warp filament above the shute float.

Figure 12C:
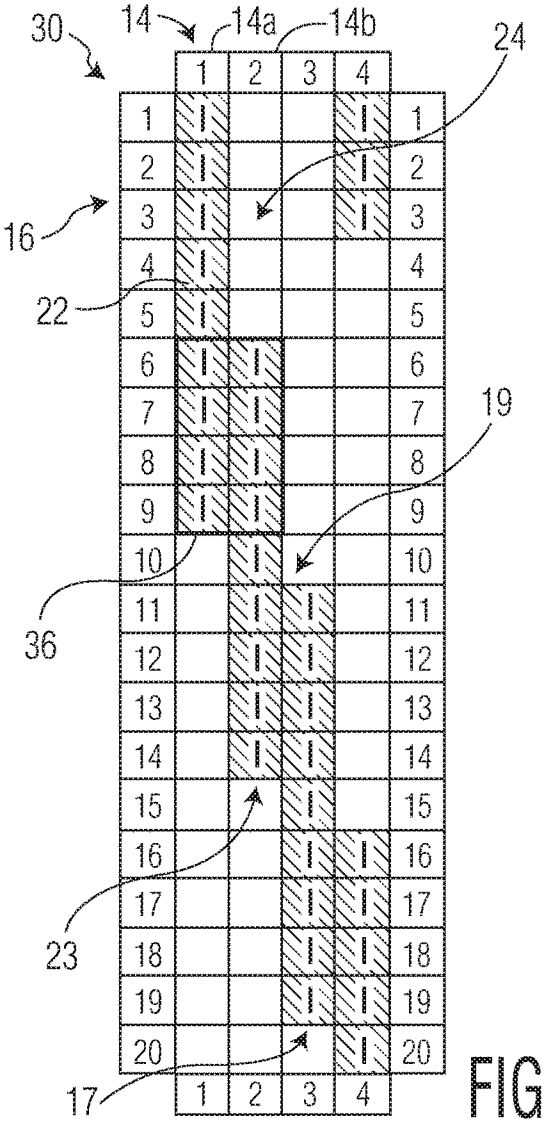
FIGS. 12A-12C illustrate various weave patterns useful in the manufacture of a woven papermaking fabric according to the present invention.
Figure 12B:
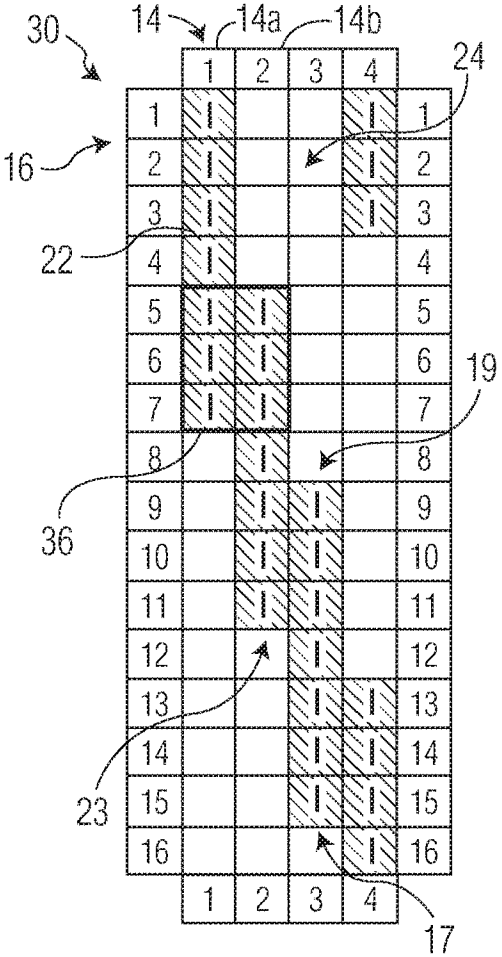
Figure 12A:
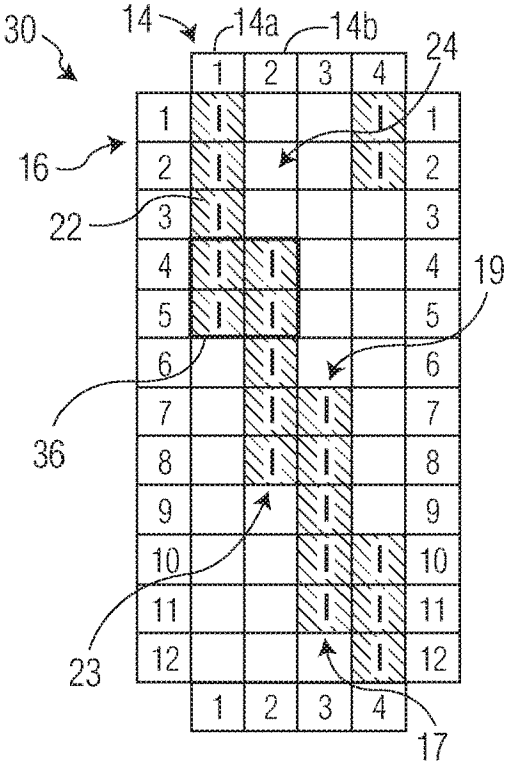

With reference now to FIGS. 12A-12C alternative weaving patterns 30 are illustrated. The illustrated weave patterns are shown to highlight different protuberance weave patterns and for clarity do not illustrate weave patterns for the respective valleys. For example, with reference to FIG. 12A a weave pattern 30 comprising four directly adjacent warp filaments 14 (warp positions 1, 2, 3 and 4) is illustrated. A protuberance 22 is formed from four adjacent filaments 14 each having been woven with interchanges where the warp filament is woven above the corresponding shute filament to provide four protuberance forming portions 23. Each protuberance forming portion 23 has a float length of five. Each protuberance forming portion 23 has a proximal end 17 and a distal end 19. The distal end 19 of a first warp filament 14 and the proximal end 17 of the directly adjacent warp filament 14 overlap to form a paired portion 36 that is two shute floats in length.

FIG. 12B illustrates a weave pattern 30 similar to that of FIG. 12A, except that the protuberance forming portion 23 has a float length of seven and the distal end 19 of a first warp filament 14 and the and the proximal end 17 of the directly adjacent warp filament 14 overlap to form a paired portion 36 that is three shute floats in length.

FIG. 12C illustrates a weave pattern 30 where the protuberance forming portion 23 of the warp filament 14 has a float length of nine and the distal end 19 of a first warp filament 14 and the and the proximal end 17 of the directly adjacent warp filament 14 overlap to form a paired portion 36 that is four shute floats in length.

Figure 13A:
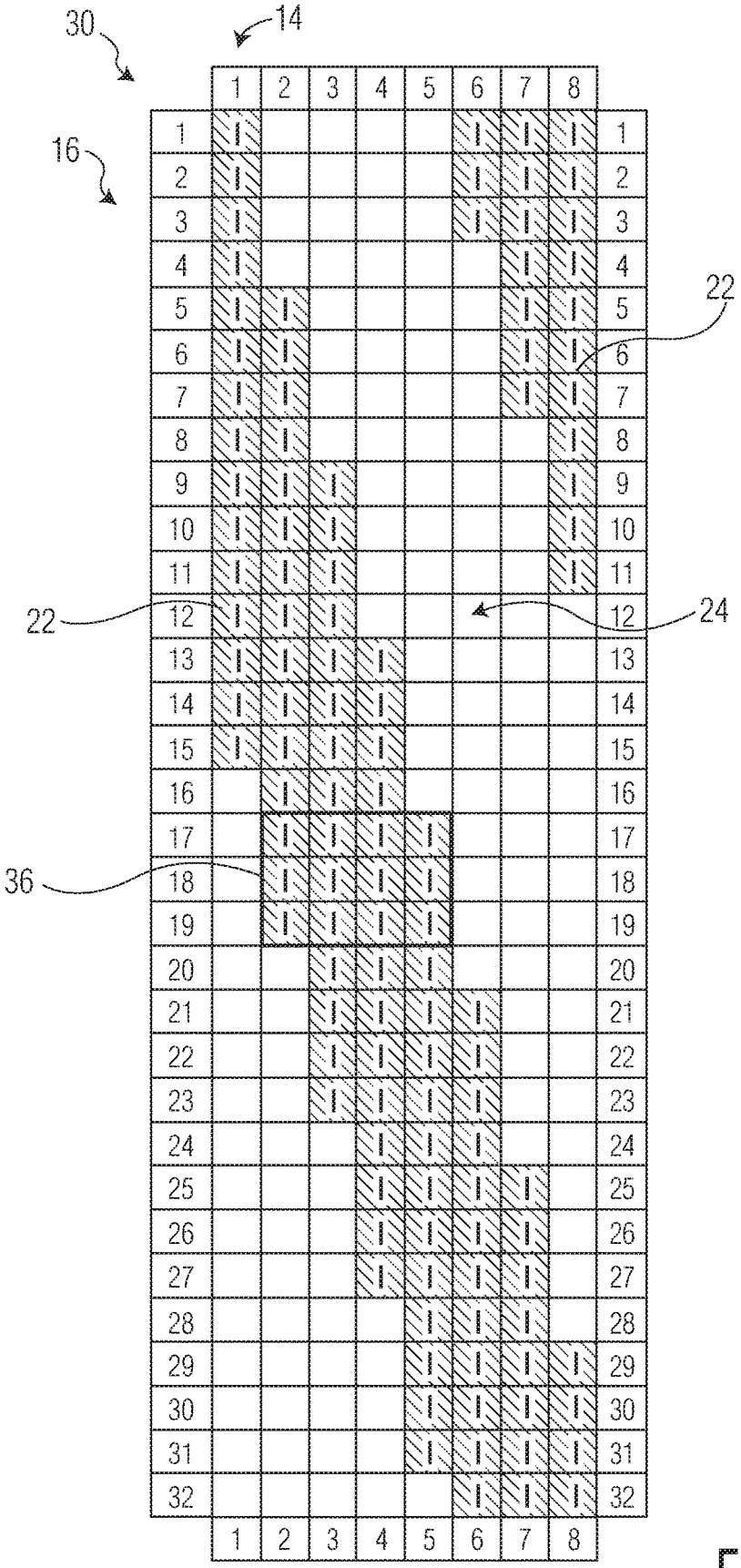
FIGS. 13A and 13B illustrate various weave patterns useful in the manufacture of a woven papermaking fabric according to the present invention.

Still another weave pattern 30 useful in the present invention is illustrated in FIG. 13A. The weave pattern 30 comprises a protuberance 22 formed from four adjacent warp filaments 14 (warp positions 2, 3, 4, 5) is illustrated. The protuberance 22 comprises four protuberance forming portions of adjacent warp filaments 14 having interchanges where the warp filament is woven above the corresponding shute filament 16. The protuberance forming portions are fifteen shute floats in length. The protuberance forming portion of adjacent warp filaments are woven such that they overlap one another to a certain extent and provide a paired portion 36. The illustrated paired portion 36 has a float length of three.

Figure 13B:
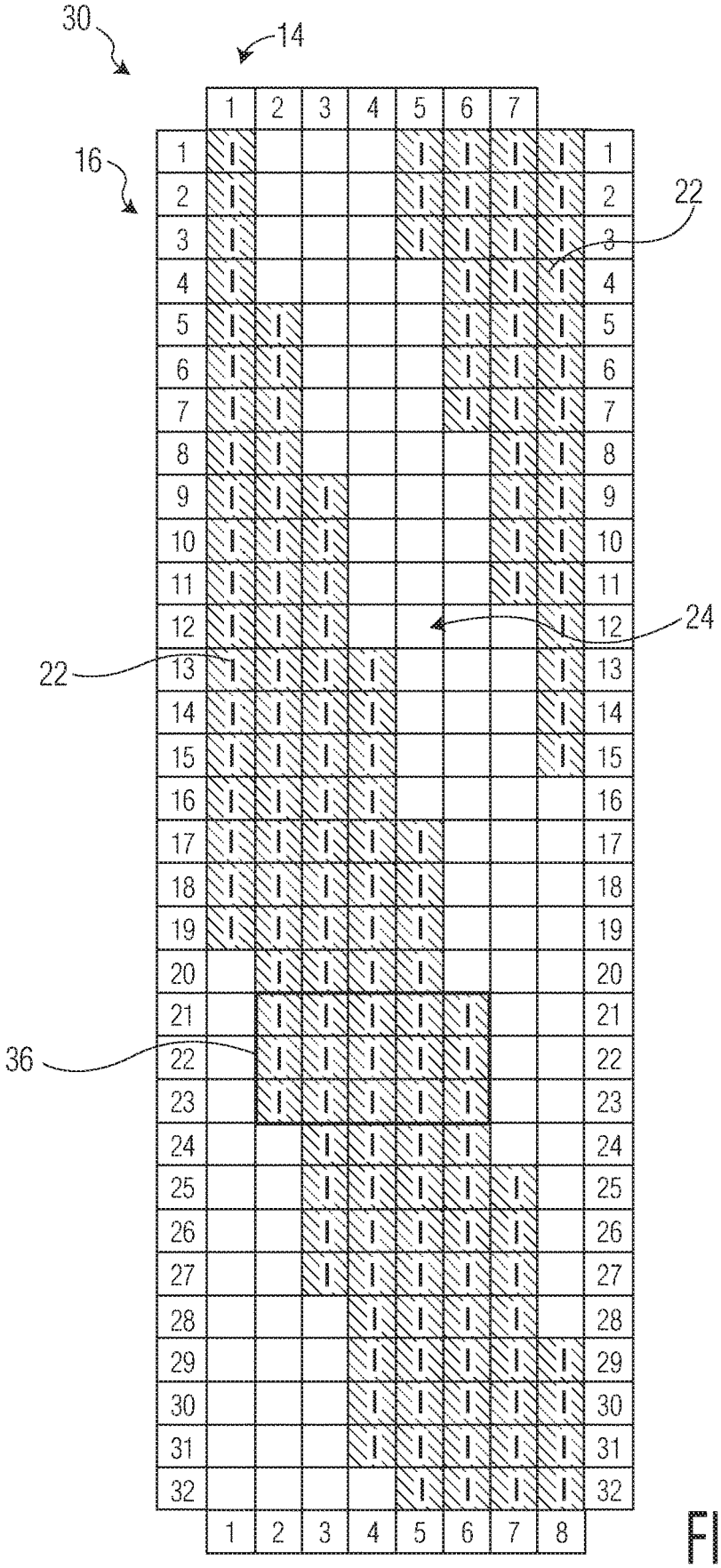

Yet another weave pattern 30 useful in the present invention is illustrated in FIG. 13B. The weave pattern 30 comprises a protuberance 22 formed from five adjacent warp filaments 14 (warp positions 2, 3, 4, 5, 6) is illustrated. The protuberance 22 comprises four protuberance forming portions of adjacent warp filaments 14 having interchanges where the warp filament is woven above the corresponding shute filament 16. The protuberance forming portions are fifteen shute floats in length. Each protuberance forming portion has a first proximal end and a first distal end and the first proximal ends of directly adjacent warp filaments is offset from one another a distances of four shute floats. Further, the protuberance forming portion of adjacent warp filaments are woven such that they overlap one another to a certain extent and provide a paired portion 36 having a float length of three.

TEST METHOD

Valley Depth, Valley Width and Wall Angle

The valley depth and angle, as well as other fabric properties, are measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter.

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μm spacing resulting in a 48 mm MD×48 mm CD field of view having a vertical resolution 100 nm and a lateral resolution 6 um. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height; and (2) Using the "Fill In Non-Measured Points" function of the Nanovea® Ultra software the non-measured points are filled by a smooth shape calculated from neighboring points.

(3) Using "Filtering>Wavyness+Roughness" function of the Nanovea® Ultra software the field is spatially low pass filtered (waviness) by applying a Robust Gaussian Filter with a cutoff wavelength of 0.095 mm and selecting "manage end effects";

(4) Using the "Filtering−Wavyness+Roughness" function of the Nanovea® Ultra software the field is spatially high pass filtered (roughness) using a Robust Gaussian Filter with a cutoff wavelength of 0.5 mm and selecting "manage end effects";

(6) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (C1), expressed in units of mm) is calculated.

The foregoing yields three values indicative of the fabric topography—valley depth, valley width and wall angle. Valley width is the Psm value having units of millimeters (mm). Valley depth is the difference between C2 and C1 values, also referred to as S90, having units of millimeters (mm). Valley angle is the Pdq value having units of degrees (°). Generally wall angle and valley width are measured along a line drawn normal to the machine direction axis of the fabric, where the line intersects at least two adjacent MD orientated protuberances.

Element Angle

Before measuring element angle, care must be taken to ensure that fabric is properly oriented before the surface map obtained by the FRT MicroSpy profilometer, as described above. To ensure that the warp filaments are aligned with the MD axis of the fabric and the shutes filaments aligned with the CD axis, a shute filament from the bottom of the fabric can be pulled by hand completely across the CD of the fabric to create a single shute filament aligned with the fabric CD axis. The single shute filament may then be used as a guide to align the fabric on the profilometer stage and a profilometer scan of the fabric may be obtained as described above.

Once a scan of the fabric is completed and the .sdf is analyzed as described above, the element angle is determined using the "texture direction" function under the "Studies" tab of the Nanovea® Ultra software. Once the "texture direction" is selected, the angle of the three most elevated features on the fabric surface will be reported. To calculate the element angle, the first value is selected and subtracted from 90. The resulting value is the element angle, having units of degrees.

EMBODIMENTS

In a first embodiment the present invention provides a woven papermaking fabric having a machine direction axis and a cross-machine direction axis, the fabric comprising: a plurality of machine direction (MD) oriented warp filaments and a plurality of substantially cross-machine direction (CD) oriented shute filaments, the shute filaments being interwoven with warp filaments to provide a machine contacting fabric side and opposed web contacting fabric side, the web contacting fabric side having a plurality of protuberances disposed thereon, the plurality of protuberances each having a length, a height and an upper surface that is substantially planar, the plurality of protuberances having a non-zero element angle and spaced apart from one another to define a plurality of valleys there between. In certain instances the element angle may range from 0.5 to 20 degrees. In other instances the element angle may range from about −20 to −0.5 degrees.

In a second embodiment the present invention provides the woven papermaking fabric of the first embodiment wherein each of the plurality of protuberances have a height that varies by less than about 150 μm along the length of the protuberance.

In a third embodiment the present invention provides the woven papermaking fabric of the first or second embodiment wherein each of the plurality of protuberances have an upper surface lying in an upper surface plane and an adjacent valley having a valley bottom plane, wherein the distance between the protuberance upper surface plane and the valley bottom plane varies less than about 150 μm along the length of the protuberance.

In a fourth embodiment the present invention provides the woven papermaking fabric of the first through third embodiments wherein each of the protuberances are discrete. In an alternate embodiment the invention provides the woven papermaking fabric of the first through third embodiments wherein each of the protuberances are continuous.

In a fifth embodiment the present invention provides the woven papermaking fabric of the first through fourth embodiments wherein each of the protuberances have an element angle from 5.0 to 10.0 degrees.

In a sixth embodiment the present invention provides the woven papermaking fabric of the first through fifth embodiments wherein each of the protuberances have a wall angle greater than about 22 degrees.

In a seventh embodiment the present invention provides the woven papermaking fabric substantially of any one of the foregoing embodiments wherein the web contacting surface has a valley depth from about 0.30 to about 1.00 mm.

In an eighth embodiment the present invention provides the woven papermaking fabric substantially of any one of the foregoing embodiments wherein the valleys constitute at least about 50 percent of the projected surface area of the web contacting surface of the fabric.

In a ninth embodiment the present invention provides the woven papermaking fabric substantially of any one of the foregoing embodiments wherein each of the protuberances comprises from 2 to 6 warp filaments.

In a tenth embodiment the present invention provides the woven papermaking fabric of any one of the foregoing embodiments wherein the protuberances may be woven from 2 to 6 directly adjacent warp filaments and each of the warp filaments has a float length from 4 to 40.

In an eleventh embodiment the present invention provides the woven papermaking fabric of any one of the foregoing embodiments wherein the protuberances may be woven from 2 to 6 directly adjacent warp filaments and each of the warp filaments has a float length from 4 to 40 and each of the warp filaments overlap one another to form a paired portion having a float length from 2 to 8.

In a twelfth embodiment the present invention provides the woven papermaking fabric of the eleventh embodiment wherein the paired portion has a first end and a second end and further comprises a pair of bands disposed at the first and the second ends.

In a thirteenth embodiment the present invention provides the woven papermaking fabric of the eleventh or twelfth embodiment wherein the pair of bands comprise a first stitch in which the interchange of warp and shute filaments comprises a warp filament above the shute float and second stitch in which the interchange of warp and shute filaments comprises a warp filament below the shute float.

In a sixteenth embodiment the present invention provides the woven papermaking fabric of any one of the foregoing embodiments wherein the protuberances are generally parallel to one another and spaced apart to define a valley there between, the valley being from two to ten warps wide.

In a seventeenth embodiment the present invention provides a woven papermaking fabric have a machine direction axis and a cross-machine direction axis, the fabric comprising: a plurality of machine direction (MD) oriented warp filaments and a plurality of substantially cross-machine direction (CD) oriented shute filaments, the shute filaments being interwoven with warp filaments to provide a machine contacting fabric side and opposed web contacting fabric side, the web contacting fabric side having a plurality of twill woven continuous MD orientated protuberances disposed thereon, the MD orientated protuberances each having a first segment having a first element angle and a second segment having a second element angle, wherein the first and second element angles are different.

In an eighteenth embodiment the present invention provides the woven papermaking fabric of the seventeenth embodiment wherein each of the plurality of MD orientated protuberances have an upper surface lying in an upper surface plane and wherein the upper surface is substantially planar.

In a nineteenth embodiment the present invention provides the woven papermaking fabric of the seventeenth or eighteenth embodiments wherein the height of each of the plurality of MD orientated protuberances varies by less than about 150 μm along the length of each of the protuberances.

In a twentieth embodiment the present invention provides the woven papermaking fabric of any one of the seventeenth through the nineteenth embodiments wherein each of the plurality of protuberances have an upper surface lying in an upper surface plane and an adjacent valley having a valley bottom plane, wherein the distance between the protuberance upper surface plane and the valley bottom plane varies less than about 150 μm along the length of the protuberance. In the foregoing embodiment the valleys may have a valley depth from about 0.30 to about 1.00 mm.

In a twenty-first embodiment the present invention provides the woven papermaking fabric of any one of the seventeenth through the twentieth embodiments wherein the first protuberance segment has an element angle from 5.0 to 10.0 degrees and the second protuberance segment has an has an element angle from −5.0 to −10.0 degrees.

What is claimed is:

1. A woven papermaking fabric having a machine direction axis and a cross-machine direction axis, the fabric comprising: a plurality of machine direction (MD) oriented warp filaments and a plurality of substantially cross-machine direction (CD) oriented shute filaments, the shute filaments being interwoven with the warp filaments to provide a machine contacting fabric side and an opposed web contacting fabric side, the web contacting fabric side having a plurality of protuberances disposed thereon and spaced apart from one another to define a plurality of valleys there between, the plurality of protuberances each having a length, a height, a uniform upper surface that is substantially planar, a non-zero element angle and a wall angle greater than about 20 degrees, the plurality of valleys having a valley bottom plane, wherein the distance between the valley bottom plane and the protuberance upper surface varies less than about 150 μm along the length of the protuberance.

2. The woven papermaking fabric of claim 1 wherein each of the plurality of protuberances have a height that varies by less than about 150 μm along the length of the protuberance.

3. The woven papermaking fabric of claim 1 wherein each of the protuberances are discrete.

4. The woven papermaking fabric of claim 1 wherein each of the protuberances are continuous.

5. The woven papermaking fabric of claim 1 wherein each of the protuberances have an element angle from 5.0 to 10.0 degrees.

6. The woven papermaking fabric of claim 1 wherein each of the protuberances have a wall angle greater than about 22 degrees.

7. The woven papermaking fabric of claim 1 wherein the web contacting surface has a valley depth from about 0.30 to about 1.00 mm.

8. The woven papermaking fabric of claim 1 wherein the valleys constitute at least about 50 percent of the projected surface area of the web contacting surface of the fabric.

9. The woven papermaking fabric of claim 1 wherein the each of the protuberances comprises from 2 to 6 warp filaments.

10. The woven papermaking fabric of claim of claim 1 wherein each of the plurality of protuberances are parallel to one another and have substantially similar height, width and length.

11. The woven papermaking fabric of claim 10 wherein each of the plurality of protuberances are continuous and define continuous valleys there between.

12. A papermaking fabric woven from a plurality of interwoven shute and warp filaments and having a machine contacting surface and an opposite web contacting surface, the web contacting surface comprising a plurality of machine direction (MD) oriented protuberances woven in a twill pattern and having a uniform upper surface that is substantially planar an element angle from 5.0 to 10.0 degrees and a wall angle greater than about 22 degrees, each of the MD oriented protuberances comprising 2 to 6 directly adjacent warp filaments, wherein each warp filament has a float length from 4 to 50 and the directly adjacent warp filaments forming the MD oriented protuberances have a paired portion having a float length from 2 to 8.

13. The papermaking fabric of claim 12 wherein each of the MD oriented protuberances are discrete.

14. The papermaking fabric of claim 12 wherein each of the MD oriented protuberances are continuous.

15. The papermaking fabric of claim 12 wherein the web contacting surface has a valley depth from about 0.30 to about 1.00 mm.

16. A woven papermaking fabric comprising a pair of spaced apart and substantially parallel machine direction (MD) oriented protuberances having an element angle from 0.5 to 10 degrees, a wall angle greater than about 22 degrees and an upper surface that is uniform along the length of the protuberance, each protuberance comprising 2 to 6 warp filaments woven above a corresponding shute filament for a float length from 4 to 50 and having a paired portion with a float length from 2 to 10, wherein the pair of MD oriented protuberances define a valley there between, the valley having a valley depth from about 0.30 to about 1.00 mm.

17. The woven papermaking fabric of claim 16 wherein no shute filaments are woven above the first and a second warp filament forming the MD oriented protuberances.

18. The woven papermaking fabric of claim 16 wherein the pair of MD oriented protuberances are discrete.

19. The woven papermaking fabric of claim 16 wherein the pair of MD oriented protuberances are continuous.

20. The woven papermaking fabric of claim 16 wherein the valley is from two to ten warps wide.

21. The woven papermaking fabric of claim 16 wherein the paired portion has a first end and a second end and the fabric further comprises a pair of bands disposed at the first and the second ends.

22. The woven papermaking fabric of claim 21 wherein the pair of bands comprise a first stitch in which the interchange of warp and shute filaments comprises a warp filament above the shute float and second stitch in which the interchange of warp and shute filaments comprises a warp filament below the shute float.

* * * * *